US009708037B2

(12) United States Patent
Ledford et al.

(10) Patent No.: US 9,708,037 B2
(45) Date of Patent: Jul. 18, 2017

(54) SHIP-BASED WATERBORNE VEHICLE LAUNCH, RECOVERY, AND HANDLING SYSTEM

(71) Applicant: LOCKHEED MARTIN CORPORATION, Bethesda, MD (US)

(72) Inventors: Jordan T. Ledford, Baltimore, MD (US); Rikard K. Haraldsson, Elkton, MD (US); Robert B. Williams, Parkville, MD (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 0 days.

(21) Appl. No.: 15/004,074

(22) Filed: Jan. 22, 2016

(65) Prior Publication Data

US 2016/0375965 A1 Dec. 29, 2016

Related U.S. Application Data

(60) Provisional application No. 62/184,048, filed on Jun. 24, 2015.

(51) Int. Cl.

| | |
|---|---|
| ***B63B 35/40*** | (2006.01) |
| ***B63B 23/48*** | (2006.01) |
| ***B63B 27/14*** | (2006.01) |
| ***B63B 27/36*** | (2006.01) |

(52) U.S. Cl.

CPC ..... *B63B 23/48* (2013.01); *B63B 27/143* (2013.01); *B63B 27/36* (2013.01)

(58) Field of Classification Search

CPC ..... B63B 23/52; B63B 23/32

See application file for complete search history.

(56) References Cited

U.S. PATENT DOCUMENTS

| | | | | |
|---|---|---|---|---|
| 5,253,605 | A | 10/1993 | Collins | |
| 5,941,660 | A | 8/1999 | Rueckert | |
| 6,408,778 | B1 | 6/2002 | Wood, II | |
| 6,520,728 | B1 | 2/2003 | Schwitters | |
| 6,792,886 | B1 * | 9/2004 | Maloney | B63B 1/06 114/60 |
| 6,953,003 | B1 | 10/2005 | Mulhern | |
| 7,503,274 | B2 | 3/2009 | Weed et al. | |
| 7,506,606 | B2 | 3/2009 | Murphy et al. | |
| 2006/0254491 | A1 | 11/2006 | Seiple | |
| 2012/0192780 | A1 * | 8/2012 | Soreau | B63B 23/32 114/259 |
| 2013/0291779 | A1 | 11/2013 | Clarke | |
| 2014/0338441 | A1 | 11/2014 | Sutherland | |
| 2015/0375667 | A1 | 12/2015 | Ledford et al. | |
| 2016/0368705 | A1 * | 12/2016 | DiSorbo | B65D 88/546 |

* cited by examiner

*Primary Examiner* — Stephen Avila

(74) *Attorney, Agent, or Firm* — Kent E. Kemeny; Andrew M. Calderon; Roberts Mlotkowski Safran Cole & Calderon, P.C.

(57) ABSTRACT

A launch, recovery, and handling system includes a track system arranged on a deck of a ship and a stern door of the ship. The launch, recovery, and handling system also includes an aft cradle and a forward cradle that are connected to the track system and moveable in first and second directions along the track system. The aft cradle is moveable from a first position at a first area inside the ship to a second position on the stern door for at least one of launching and recovering a payload.

20 Claims, 17 Drawing Sheets

SHIP-BASED WATERBORNE VEHICLE LAUNCH, RECOVERY, AND HANDLING SYSTEM

FIELD OF THE INVENTION

The invention is directed to a payload transporting and handling system. More particularly, the invention is directed to a launch, recovery, and handling system and related components which can efficiently and effectively move waterborne vehicles and other items off of, on to, and within a ship.

BACKGROUND DESCRIPTION

Naval vessels traditionally have been designed to be stand-alone entities capable of performing missions with direct line of sight. As the cost to build and maintain ships becomes more expensive, a substantial risk is involved in performing missions directly. This has contributed to the rise of so-called "mothership" vessels being used as a staging and deployment platform for smaller marine vehicles and equipment such as Rigid-Hull Inflatable Boats (RHIBs), Combat Rubber Raiding Crafts (CRRCs), Autonomous Underwater Vehicles (AUVs) or Unmanned Underwater Vehicles (UUVs), and small-submersibles, among others. These allow for over the horizon mission capability with mothership support without risking the larger mothership vessel itself. In order to accommodate these smaller marine vehicles, specialized launch and recovery equipment is designed and incorporated into the mothership vessel arrangement. Vessels such as the freedom-class Littoral Combat Ship (LCS) have limited space and ability to launch these smaller marine vehicles, which creates a need for specialized, rapid, compact, and cost-effective launch, recovery, and handling systems (LRHS). Such systems are typically custom-designed to fit the mothership vessel and therefore difficult to offer as a standard design.

Handling multiple waterborne vehicles on board a ship is not an uncommon practice. Some ships have utilized multiple fixed-angle ramps in order to accommodate more than one RHIB vehicle at a time. Still others have utilized a conveyor system to transport a RHIB vehicle from a launch/recovery location to a separate stowage location within the ship. Overhead, gantry, and davit cranes are also frequently utilized to move vehicles within a ship. Davit cranes typically launch and recover RHIBs over the port or starboard sides of the ship, and utilize the same crane footprint for stowage. Overhead and/or gantry cranes can maneuver vehicles within the interior spaces of a ship and sometimes extend out of the stern or side door to launch vehicles.

SUMMARY OF THE INVENTION

In an aspect of the invention, a launch, recovery, and handling system includes a track system arranged on a deck of a ship and a stern door of the ship. The launch, recovery, and handling system also includes an aft cradle and a forward cradle that are connected to the track system and moveable in first and second directions along the track system. The aft cradle is moveable from a first position at a first area inside the ship to a second position on the stern door for at least one of launching and recovering a payload.

In another aspect of the invention, a launch, recovery, and handling system includes: a track system arranged on a deck of a ship; an aft cradle and a forward cradle that are connected to the track system and moveable in first and second directions along the track system; and a lock assembly that is structured and arranged to provide first, second and third locking modes of the aft cradle. The aft cradle is moveable from a first position at a first area inside the ship to a second position on the stern door for at least one of launching and recovering a payload. The stern door is pivotable relative to a hull of the ship between a closed position, a first open position, and a second open position. The aft cradle comprises trucks that roll on the track system.

In still yet another aspect of the invention, a method of using a launch, recovery, and handling system includes: supporting a first waterborne vessel on an aft cradle in a first area of a ship; supporting a second waterborne vessel on a forward cradle in a second area of the ship; and moving the aft cradle and the first waterborne vessel along a track system to a launch and recovery ramp, wherein the track system is arranged at both the first area of the ship and the launch and recovery ramp. The method also includes: deploying the first waterborne vessel from the aft cradle into a body of water surrounding the ship; moving the aft cradle, along the track system, from the launch and recovery ramp to the first area; moving the second waterborne vessel from the forward cradle and onto the aft cradle; moving the aft cradle and the second waterborne vessel along the track system to the launch and recovery ramp; and deploying the second waterborne vessel from the aft cradle into the body of water surrounding the ship.

BRIEF DESCRIPTION OF THE DRAWINGS

The invention is described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF EMBODIMENTS OF THE INVENTION

Figure 1:
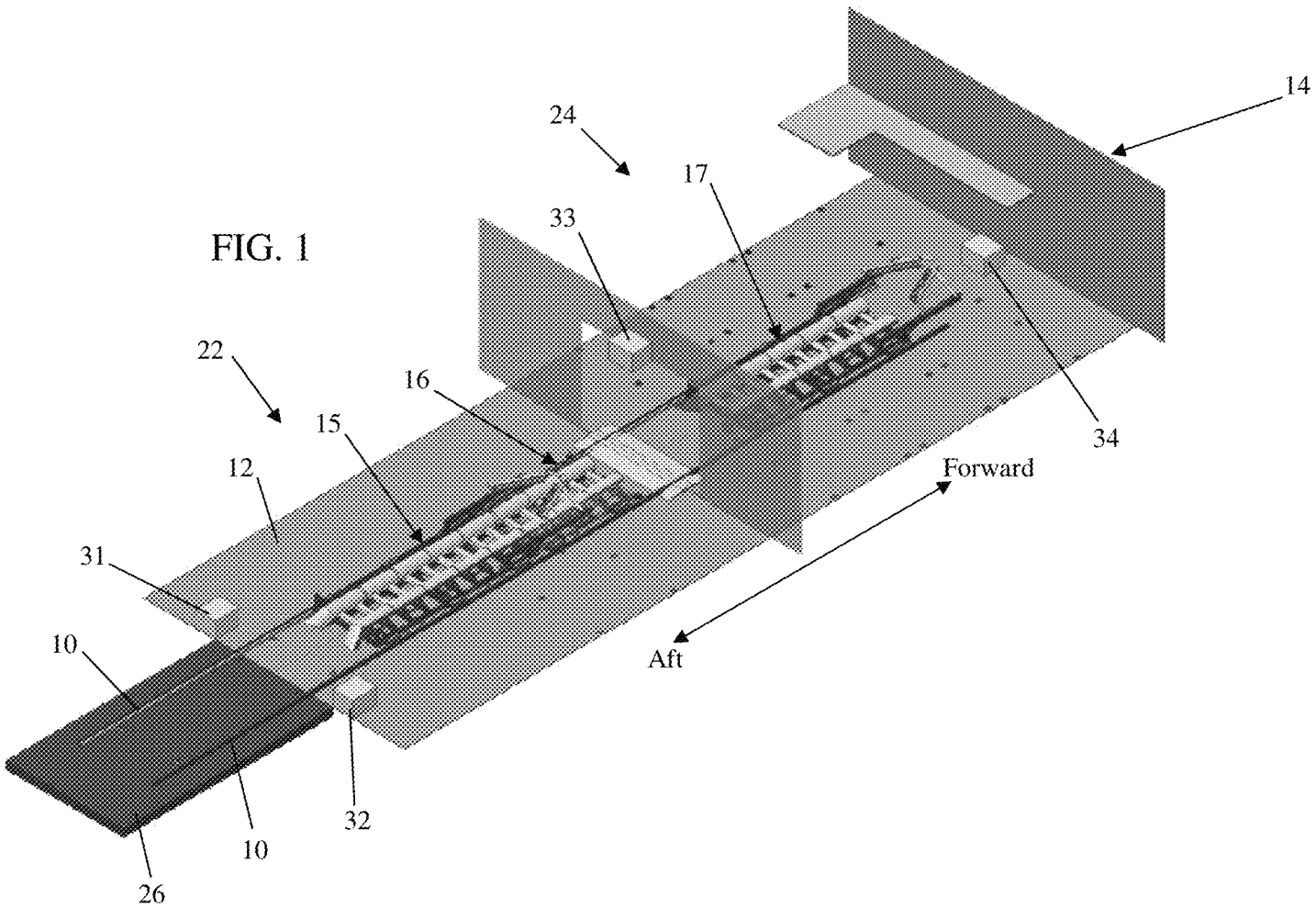
FIG. 1 shows an overview of a system and related components of the present invention.

The invention is directed to a payload transporting and handling system. More particularly, the invention is directed to a launch, recovery, and handling system and related components which can efficiently and effectively move waterborne vehicles and other items in a ship. According to aspects of the invention, a system includes track sections that are affixed to a deck of a ship, and cradles that are connected to and moveable along the track sections. In embodiments, payload (such as a waterborne vehicle) is stowed on the cradles and moved along the track sections to accomplish launch, recovery, and handling system (LHRS) operations on the ship. In aspects described herein, a portion of the track sections are affixed to a stern door of the ship, such that the stern door functions as both a door and a launch and recovery ramp. In embodiments, transfer cradles and winches are used to transition a payload (e.g., a waterborne vehicle) from a first cradle to a second cradle, for example between stowage and launch/recovery positions.

Aspects of the present invention utilize winches attached to a payload that is moved along a track and rail system in order to accomplish LRHS tasks. In embodiments, the winches are attached to either end of the payload such that one winch pulls in the movement direction while the second maintains tension by paying out line. The payload may include but is not limited to equipment, waterborne vehicles, and stowage cradles. A rail-to-truck-and-frame interface may be utilized to allow the payload to vary in size and weight within space and/or equipment limits. The tracks may be permanent or removable from the deck depending upon projected usage and mission needs. Additionally, modular tracks may be utilized in order to move payloads between multiple different locations within the ship spaces. An advantage of such modularity is minimizing the weight of the entire system.

An exemplary embodiment utilizes longitudinally-oriented track assemblies to move payloads along the ship longitudinal centerline between launch locations and stowage locations. Additional aspects are configured to permit movement along tracks in directions other than along the ship longitudinal centerline, e.g., with appropriate design and placement of track sections such as rotatable track sections, curved tracks, and/or tracks oriented in the athwartship direction. In a preferred embodiment, the equipment is designed for waterborne vehicles (e.g., RHIBs) to allow movement between stowage cradles in cases where multiple waterborne vehicles are required for the mission objective. This eliminates the need to remove cradles in order to launch (and recover) vehicles that would otherwise be blocked in by the empty cradle. Allowing vehicles and equipment to transition over or through cradles is unique among currently available solutions.

Aspects of the invention advantageously provide flexibility in implementing the system on different mothership vessels and for use with different waterborne vehicles. For example, due to modular construction in both the cradle piece as well as the track system, implementations of the invention may be designed to accommodate multiple different types of waterborne vehicles (e.g., RHIBs, CRRCs, AUVs, UUVs, etc.) with minimal changes. This is in contrast to fixed-angle ramps that are specialized and limited to stow only one type of waterborne vehicle, and which cannot be easily changed to accommodate different types of waterborne vehicle. Similarly, conventional conveyor systems require extensive modification to existing spaces within a ship and are not removable, and thus cannot easily accommodate changing out mission equipment.

Aspects of the invention advantageously do not require or utilize any type of crane, such as overhead, gantry, and davit cranes. Cranes are expensive to purchase and maintain on a ship. For example, cranes typically require specialized rigging in order to move equipment, which has to be designed and purchased separately, adding to cost. Cranes also are very heavy and typically elevated within the mission spaces which can negatively affect ship stability (VCG). Moreover, an inoperative crane can cripple launch and recovery missions. An exemplary embodiment of the invention utilizes winches, instead of a crane, to control the launch, recovery, and handling movements of waterborne vehicles at the ship. Compared to conventional overhead, gantry, and davit cranes, winches are significantly less expensive, more robust, and easier to maintain. The winch setup may be eliminated, e.g., when required by a customer, by incorporating motors into the truck assemblies or utilizing a centerline rack to interface with a motor/gear system.

Advantageously, the system of the present invention offers many advantages over conventional LRHS systems that use separate cradles for waterborne vehicle stowage and LRHS operations. Aspects of the invention combine those functions into one cradle, allowing a single cradle to be used to stow vehicles/equipment as well as facilitate LRHS operations. This multi-functionality results in less equipment overall and thus advantageously reduces amount of space used, amount of spares needed, cost, and weight. Moreover, additional space to stow an empty cradle is not necessary with implementations of the invention because vehicles/equipment may pass over cradles in the inventive system during LRHS operations. Other advantages provided by aspects of the invention include, without limitation:

(i) the overall system combines components to function as one dedicated LRHS;

(ii) space is maximized because cradles can be used for any movement direction;

(iii) a simple powered movement system is provided using multiple winches working in unison (e.g., payout/tension) so that no braking system necessary;

(iv) the track system may be removed from the deck of the ship;

(v) a universal cradle may be configured to accommodates multiple different types of waterborne vehicles;

(vi) the cradles may be configured to carry payload other than waterborne vehicles, such as mission modules and equipment;

(vii) the system does not utilize overhead cranes for LHRS operations of waterborne vehicles;

(viii) the system provides reduced operational time because cradles do not have to be moved out of engagement with the track sections;

(ix) the track sections are modular and can configured on the deck to achieve specific movements/locations;

(x) the system facilitates waterborne vehicles being moved forward and aft between different cradles; and (xi) specially configured hubs may be utilized between the cradles and track sections that provide the ability to change movement direction of a cradle, allowing for multiple stowage locations to be utilized.

FIG. 1 shows an overview of a system in accordance with aspects of the invention. In embodiments, the system includes track sections 10 connected to surfaces (e.g., interior decks) 12 of a ship 14, and cradles 15, 16, 17 connected to the track sections 10. The cradles 15-17 are configured to carry a payload, such as a waterborne vessel (a RHIB in this embodiment). According to aspects of the invention, at least one of the cradles (e.g., cradles 15 and 16 in this example) is moveable in forward and aft directions along the track sections 10 for the purpose of facilitating launch and recovery operations of the waterborne vessel out of and into the ship 14.

As shown in FIG. 1, the track sections 10 may span plural areas of the ship 14 including a first area 22 (e.g., a water mission zone (WMZ) area) and a second area 24 (e.g., a storage area). The areas 22, 24 may be separated by a bulkhead, and an opening in the bulkhead may be provided with a watertight threshold. The ship 14 may comprise any suitable marine vessel that is capable of carrying and deploying at least one waterborne vessel. For example, and without limitation, the ship 14 may be any desired type of ship such as a cutter, a frigate, a Littoral Combat Ship (LCS), or a Multi-mission Combat Ship (MCS). Moreover, implementations of the invention are not limited to use with ships, and instead may be utilized in other environments such as a warehouse environment.

With continued reference to FIG. 1, in embodiments, a portion of the track section 10 is connected to a stern door 26 of the ship 14. The stern door 26 is pivotable relative to a hull of the ship 14 such that the stern door 26 may be opened during launch and recovery operations of the waterborne vessel and may be closed at other times. In this manner, the stern door 26 with the connected track sections 10 functions as both a door for closing an opening in the hull 28 and also as a ramp for launch and recovery operations of the waterborne vessel.

As shown in FIG. 1, aspects of the invention utilize winches 31, 32, 33, 34 to control movement of the cradles 15, 16 along the track sections 10. In embodiments, the winches 31-34 are arranged in a payout/tension configuration to simultaneously control both forward and aft movement of one or more of the cradles 15, 16 along the track sections 10, which advantageously eliminates the need for a braking system.

Figure 2:
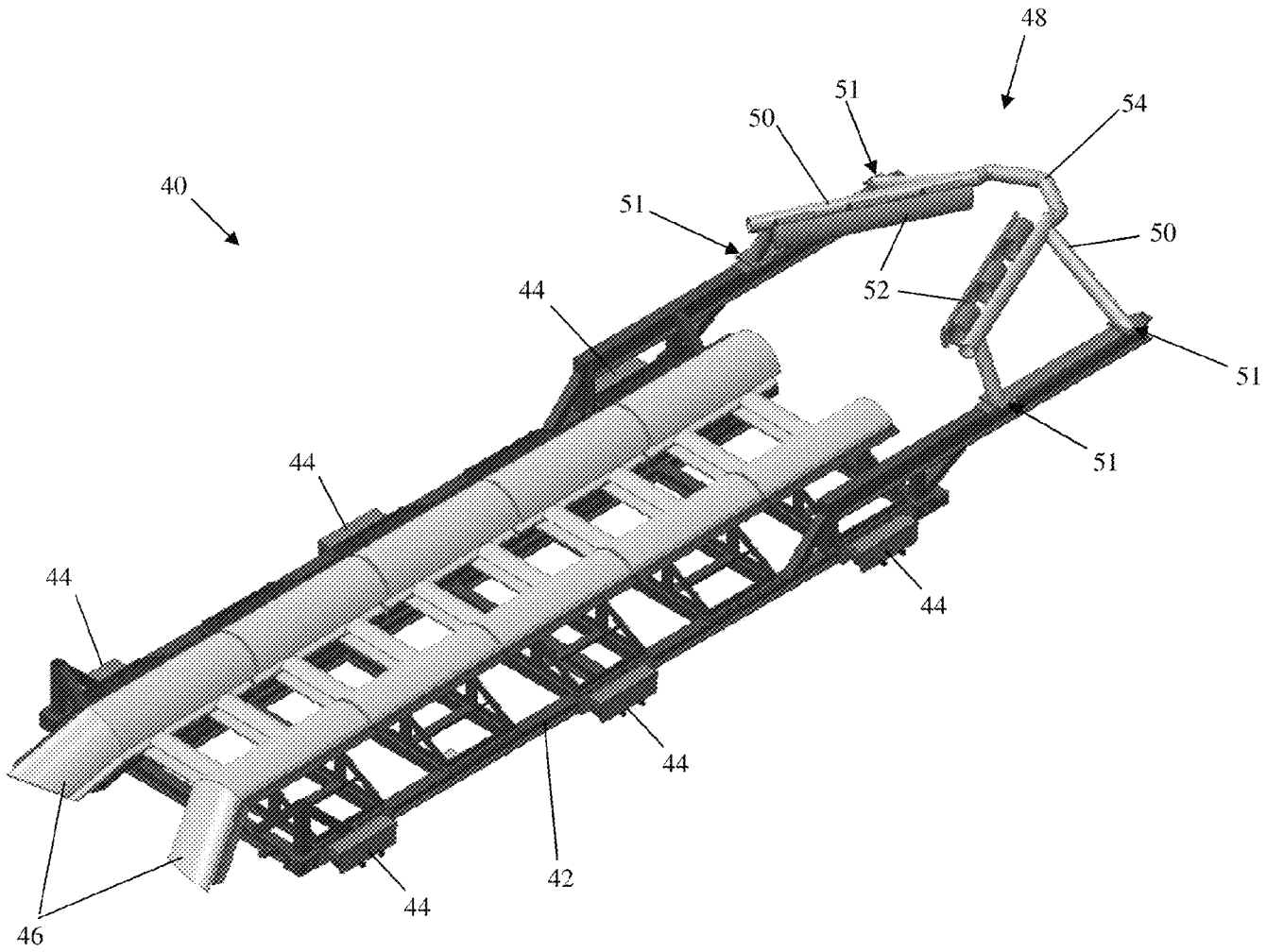
FIGS. 2 and 3 show aspects of cradles used in a system according to aspects of the present invention.

FIG. 2 shows a detailed view of a vehicle cradle 40 in accordance with aspects of the invention. Respective ones of the vehicle cradle 40 may be utilized for both the aft cradle 15 and forward cradle 17 shown in FIG. 1. In embodiments, the vehicle cradle 40 includes a frame 42 and a plurality of trucks 44 connected to the frame 42. The frame 42 may be configured in any desired size and shape, e.g., to accommodate various payloads. In the example described herein, the frame 42 is sized and shaped to carry a waterborne vessel such as a RHIB. The frame 42 may be of any suitable construction, such as, for example, metallic structural members that are welded and/or bolted together.

In a particular exemplary implementation, the vehicle cradle 40 has a length of about 355 inches, a width of about 109 inches, and a height of about 44 inches. In this manner, the cradle 40 is sized and shaped to carry a waterborne vessel such as a RHIB, but also to fit within a standard 20 foot ISO shipping container. Implementations of the invention are not limited to this example, and any desired size and shape cradle 40 may be used within the scope of the invention.

The trucks 44 are affixed to the frame 42 and facilitate movement of the vehicle cradle 40 along track sections (e.g., track sections 10 shown in FIG. 1), as described in detail with respect to FIGS. 4-7. In embodiments, six trucks 44 are attached to each frame 42, although any number of trucks 44 may be used. The trucks 44 may be connected to the frame 42 in any suitable manner, such as welded, bolted, and integrally formed, without limitation.

Still referring to FIG. 2, the cradle 40 may include one or more fenders 46 connected to the frame 42. The fenders 46 are configured to minimize damage to the waterborne vessel and/or frame 42 by absorbing impacts between the waterborne vessel and frame 42. The fenders 46 are arranged on the frame 42 such that the waterborne vessel sits on the fenders 46 when the waterborne vessel is supported on the cradle 40. The fenders 46 may be composed of any suitable material or materials, such as ultra-high-molecular-weight polyethylene (UHMWPE), as but one example. The fenders 46 may be connected to the frame 42 in any suitable manner, such as bolted on, for example.

With continued reference to FIG. 2, the cradle 40 may include a bow stop 48 connected to the front/forward end of the frame 42. The bow stop 48 may include frame members 50 and optional fenders 52. The bow stop 48 functions to arrest forward movement of the waterborne vessel relative to the cradle 40, e.g., during recovery operations when the waterborne vessel drives up onto the cradle 40 at a high rate of speed. The bow stop 48 may be detachable from the frame 42. In one exemplary embodiment, two frame members 50 of the bowstop 48 are selectively connected to one another at a central location 54, and are detachable from one another at this location 54. In this exemplary embodiment, the two frame members 50 are each pivotably connected to the frame 42, e.g., at locations 51, and when detached from one another are rotatable to positions outboard of the frame 42.

Figure 3:
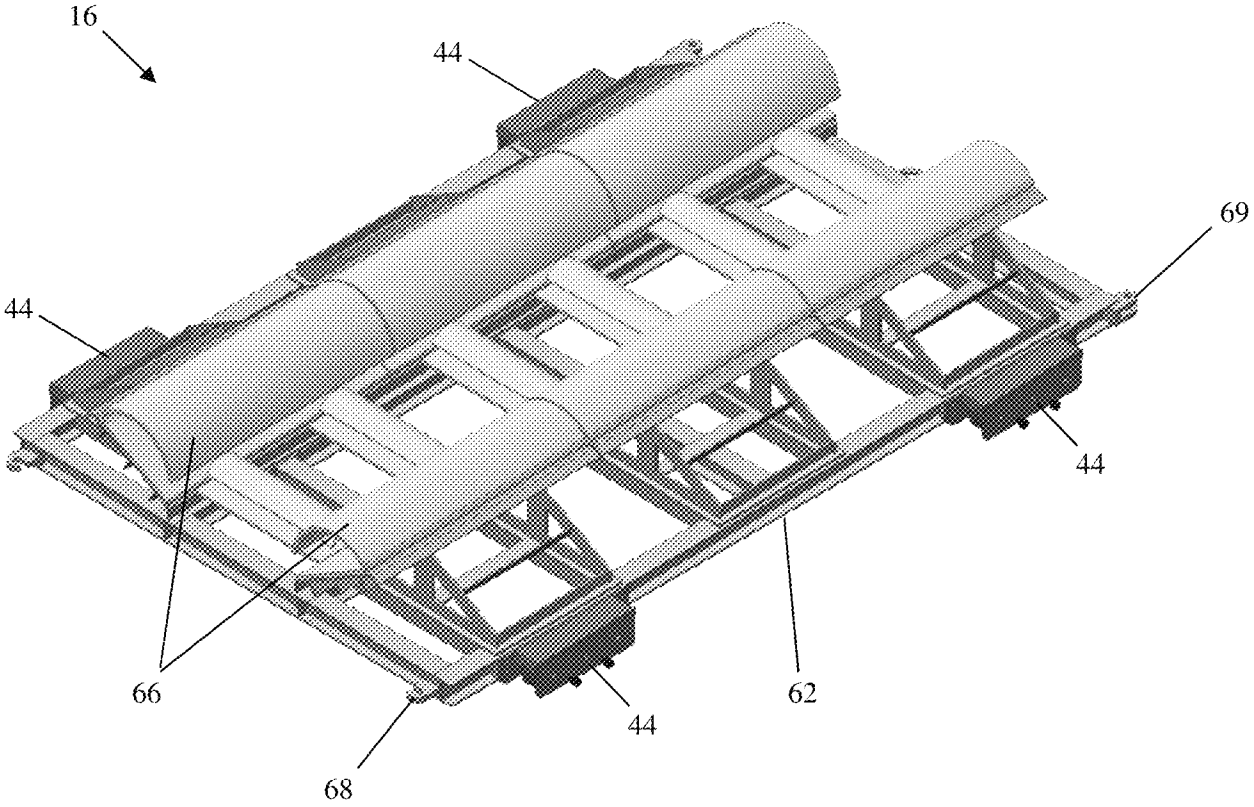
Figure 7:
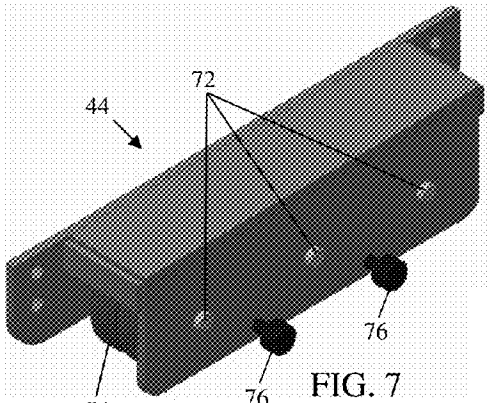
FIGS. 4-8, 9A, and 9B show aspects of trucks and a track section used in a system according to aspects of the present invention.
Figure 6:
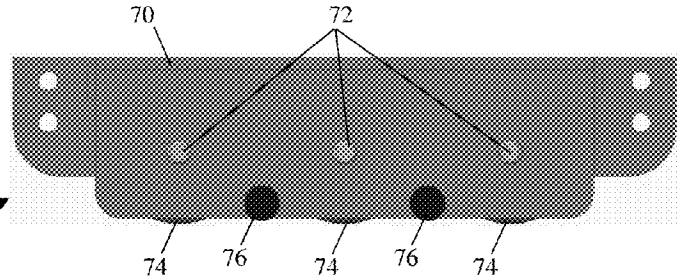
Figure 5:
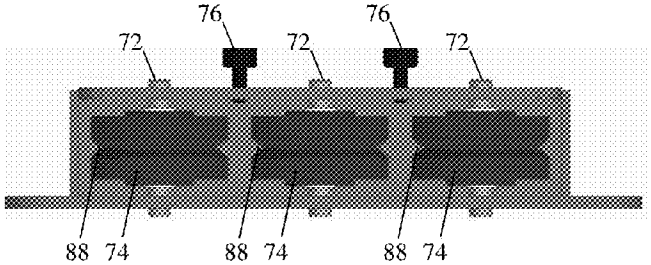

FIG. 3 shows a detailed view of a transfer cradle 16 in accordance with aspects of the invention. In embodiments, the transfer cradle 16 includes a frame 62 and a plurality of trucks 44 connected to the frame 62. The frame 62 may be configured in any desired size and shape, e.g., to accommodate various payloads. The frame 62 may be of any suitable construction, such as, for example, metallic structural members that are welded and/or bolted together.

In a particular exemplary implementation, the transfer cradle 16 has a length of about 153 to 154 inches, a width of about 109 inches, and a height of about 23 inches. Implementations of the invention are not limited to this example, and any desired size and transfer cradle 16 may be used within the scope of the invention.

The trucks 44 are affixed to the frame 62 and facilitate movement of the transfer cradle 16 along track sections (e.g., track sections 10 shown in FIG. 1), as described in detail with respect to FIGS. 4-7. In embodiments, four trucks 44 are attached to the frame 62, although any number of trucks 44 may be used. The trucks 44 may be connected to the frame 62 in any suitable manner, such as welded, bolted, and integrally formed, without limitation.

Still referring to FIG. 3, the transfer cradle 16 may include one or more fenders 66 connected to the frame 66. The fenders 66 may be similar to fenders 46 described with respect to the cradle 40. For example, in a non-limiting example, the fenders 66 may include UHMWPE that are bolted onto the frame 62. Alternatively, the fenders 66 of the transfer cradle 16 may be different than the fenders 46 since in some embodiments the transfer cradle 16 typically will not need to absorb impacts, and instead are used to support the vehicle/equipment weight during operations. When similar fenders are used, the fenders of one cradle can be used as spares for another cradle in the event that damage occurs to the other cradle and the capability for LRHS operations is still required.

With continued reference to FIG. 3, the transfer cradle 16 may further include at least one transfer cradle lock element 68 in accordance with aspects of the invention. In embodiments, the transfer cradle lock element 68 is configured to selectively lock with a corresponding element on a forward end of the aft cradle 15 as described herein with respect to FIGS. 10-16. The transfer cradle 16 may also include at least one transfer cradle lock element 69 that is configured to selectively lock with a corresponding element on an aft end of the forward cradle 17, e.g., in a similar manner.

Figure 4:
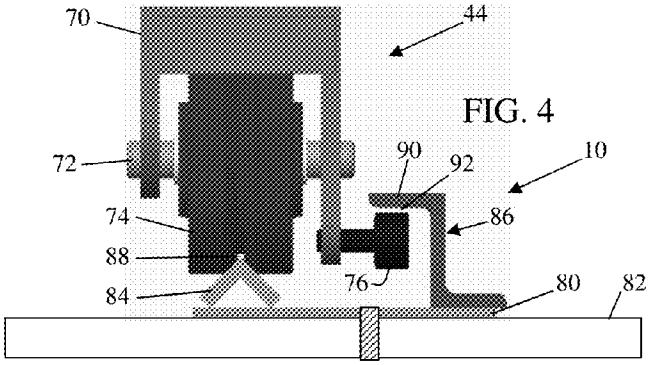

FIGS. 4-7 illustrate aspects of the truck 44 in accordance with aspects of the invention. In embodiments, each truck 44 includes a truck frame 70, a number of axles 72, a number of wheels 74, and a number of cam followers 76. In the exemplary implementation shown in FIG. 4, the truck frame 70 includes a top member and downward depending members. The axle 72 is rotatably held in the downward depending members, e.g., by one or more bearings and/or bushings. The wheel 74 is connected to the axle 72 such that the wheel 74 may rotate relative to the truck frame 70 about an axis of rotation that is defined by the axle 72. The truck 44 in FIG. 4 is shown having three axles 72 and three wheels 74; however any desired number may be used within the scope of the invention.

FIG. 4 also shows a portion of a track section 10 in accordance with aspects of the invention. In embodiments, the track section 10 includes a base element 80 that is configured to be connected to a surface 82 (e.g., a deck or floor surface) of the ship 14, a wheel guide 84 connected to the base element 80, and a displacement limiter 86 connected to the base element 80. The wheel guide 84 and displacement limiter 86 may be connected to the base element 80 in any suitable manner, such as welding.

In embodiments, the track section 10 and the truck 44 are structured and arranged such that the wheel 74 contacts and is rollable along the wheel guide 84. In a particular embodiment, each wheel 74 includes a groove 88 that engages a portion of the wheel guide 84 to inhibit movement of the truck 44 relative to the track section 10 in a transverse direction. For example, the wheel guide 84 may comprise an element having two surfaces arranged at non-zero angles relative to the surface 82 of the ship 14, and the wheel 74 may comprise angled surfaces (defined by the groove 88) that contact and ride on the angled surfaces of the wheel guide 84. The engagement of the respective angled surfaces prevents movement of the truck 44 in a transverse direction relative to a direction that the truck 44 rolls along the track section 10. Implementations of the invention are not limited to an angle guide, and other types of track profile may be used. For example, aspects of the invention may be implemented with a rail guide that is similar to train wheels or a single vertical piece that the wheel sits around and serves as a limiting guide rail preventing transverse motion.

Still referring to FIG. 4, in embodiments the track section 10 and the truck 44 are structured and arranged to cooperate with one another to prevent unwanted movement of the truck 44 in a vertical direction relative to the surface 82 of the ship 14. For example, the displacement limiter 86 of the track section 10 may include an overhang element 90 that is vertically over the cam follower 76 of the truck 44 when the wheel 74 is on and contacting the wheel guide 84. The elements may be sized such that a clearance 92 is provided between the overhang element 90 and the cam follower 76. In this arrangement, the truck 44 may move in a vertical direction relative to the surface 82 of the ship 14 only to the extent defined by the clearance 92. However, when the truck 44 moves vertically such that the cam follower 76 comes into contact with the bottom surface of the overhang element 90, then any further vertical movement of the truck 44 is prevented by the contact between the cam follower 76 and the overhang element 90. Implementations of the invention are not limited to a cam follower, and other systems may be used. For example, aspects of the invention may be implemented with a low-friction guide rail instead of a cam follower.

Figure 8:
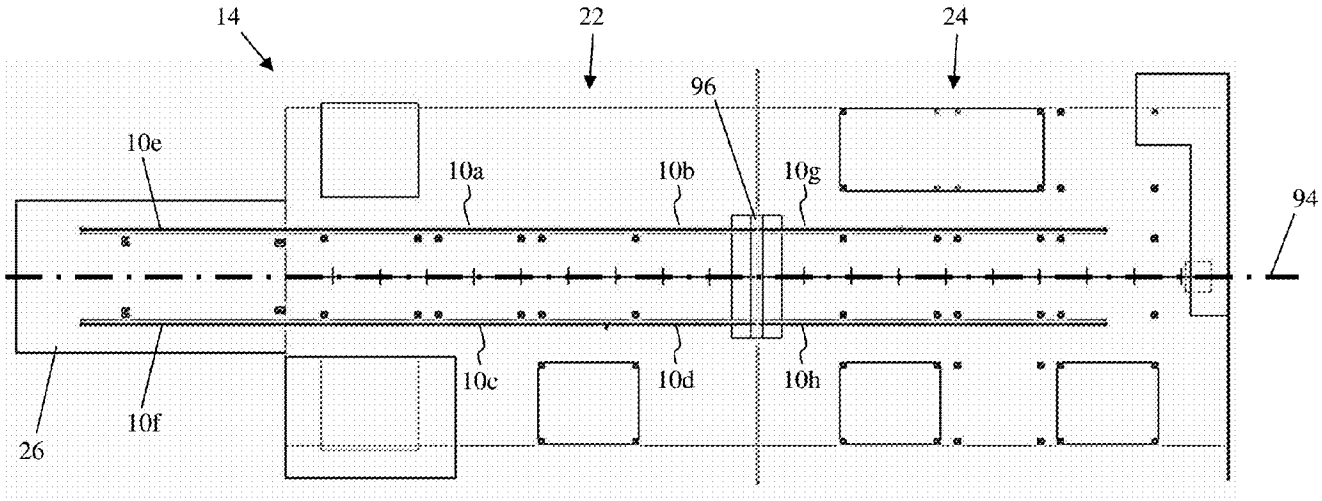

According to aspects described herein, the track sections 10 are modular and removably connected to the surface 82 of the ship 14. For example, and without limitation, the base element 80 of each respective track section 10 may be bolted to the surface 82 of the ship 14, e.g., as shown in FIG. 4. In this manner, plural track sections 10 may be arranged on the surface 82 of the ship 14 to form a track system that the cradles (e.g., cradles 15-17) may be moved along. For example, as shown in FIG. 8, first track section 10*a* and second track section 10*b* may be connected to the surface 82 of the ship in an aligned and end-to-end manner such that the wheel guide of the first track section 10*a* is aligned with the wheel guide of the second track section 10*b*. Third and fourth track sections 10*c*, 10*d* may be arranged in a similar manner and spaced apart from the first and second track sections 10*a*, 10*b*. In this manner, the trucks on one side of a cradle may roll uninterrupted from first track section 10*a* to second track section 10*b*, and the trucks on the other side of the same cradle may roll uninterrupted from third track section 10*c* to fourth track section 10*d*.

Still referring to FIG. 8, a track system of plural track sections may be arranged in any desired pattern on one or more surfaces of the ship. For example, in addition to track sections 10*a-d* shown on the deck in the first area 22, additional track sections 10*e*, 10*f* may be connected to the stern door 26, and additional track sections 10*g*, 10*h* may be connected to the deck in the second area 24. In this manner, a cradle with trucks as described herein may roll along the track sections from the stern door, through the first area 22, and into the second area 24, and vice versa. In the exemplary implementation shown in FIG. 8, the track system includes two parallel runs of plural track sections, wherein each run is parallel to and transversely spaced apart from a longitudinal centerline 94 of the ship 14. Implementations of the invention are not limited to two parallel runs of plural track sections, and other systems may be used. For example, aspects of the invention may be implemented with a single (i.e., one) guide track along a centerline or off-center if desired.

Figure 9B:
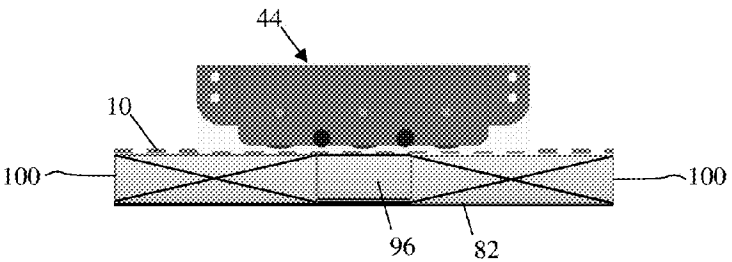
Figure 9A:
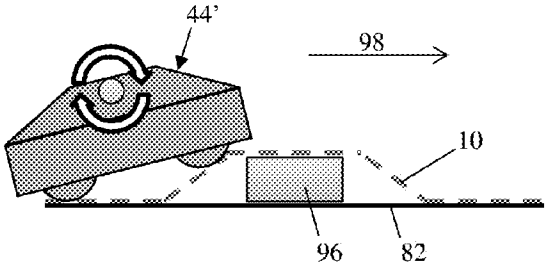

As depicted in FIG. 8, the ship 14 may have a threshold 96, e.g., for preventing water from flowing from one location (e.g., first area 22) to another location (e.g., second area 24). FIGS. 9A and 9B illustrate exemplary track and truck configurations that may be used to traverse such a threshold 96 with a cradle as described herein. In the embodiment shown in FIG. 9A, the truck 44' is rotationally connected (e.g., gimbaled) to the frame of the cradle. The track sections 10, denoted by dashed lines, are installed horizontally on the deck surface 82, horizontally on a top of the threshold 96, and at angles to span the height between the deck surface 82 and top of the threshold 96. Since the truck 44' is gimbaled relative to the frame of the cradle, the truck 44' follows the track profile up and over the threshold 96 and back down the other side when the cradle is moving in the direction shown by arrow 98. In this embodiment, each cradle has four trucks 44' (instead of six), and each truck has two wheels (instead of three). The wheels and track profile in the embodiment of FIG. 9A may also be wider than the wheels and track profile used in the embodiment of FIG. 9B.

In the embodiment shown in FIG. 9B, the track sections 10 are elevated to height above the deck surface 82. For example, structural members 100 may be placed between the track sections 10 and the deck surface 82, such that the track sections 10 are installed at a height equal to or higher than the top surface of the threshold 96. In this embodiment the truck 44 may be fixedly (non-rotatably) connected to the frame of the cradle. In embodiments, the track sections and structural members could be a same element, i.e., elevated single track sections.

FIGS. 10-16 show aspects of a cradle interface and lock assembly in accordance with aspects of the invention. In embodiments, the lock assembly is structured and arranged to operate in three modes: (i) selectively locking the aft cradle 15 to the transfer cradle 16 while permitting both to move (roll) as a unit along the track sections; (ii) selectively locking the aft cradle 15 to the transfer cradle 16 and to a deck of the ship, thus preventing both the vehicle cradle 15 and the transfer cradle 16 from moving (rolling) along the track sections; and (iii) selectively locking the aft cradle 15 to the a deck of the ship, while disengaging the aft cradle 15 from the transfer cradle 16, thereby maintaining the aft cradle 15 in a fixed position and permitting the transfer cradle 16 to move (roll) along the track sections. In embodiments, the lock assembly is structured and arranged to provide vertical retention of the forward end of the aft cradle 15 to prevent buoyancy forces from lifting the aft cradle 15 off the track sections. In embodiments, the lock assembly is structured and arranged to be actuated by a human operator located far away from the stern door, e.g., for safety. The actuation may be achieved, for example, using a lever, cable, and linkage system connected to the cradles. In further embodiments, the lock assembly includes positive detents or other positive engagement features to inform operator which of the three modes the lock assembly is in at any given time. In embodiments, the lock assembly may be actuated electrically, hydraulically, and remotely.

Figure 10:
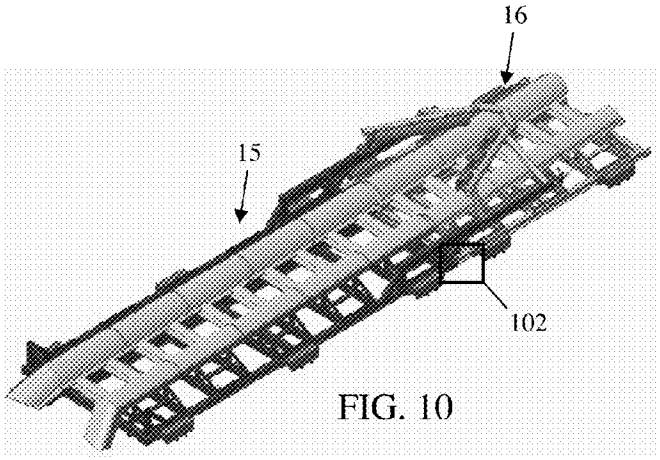
FIGS. 10-16 show aspects of a lock assembly in a system according to aspects of the present invention.
Figure 11:
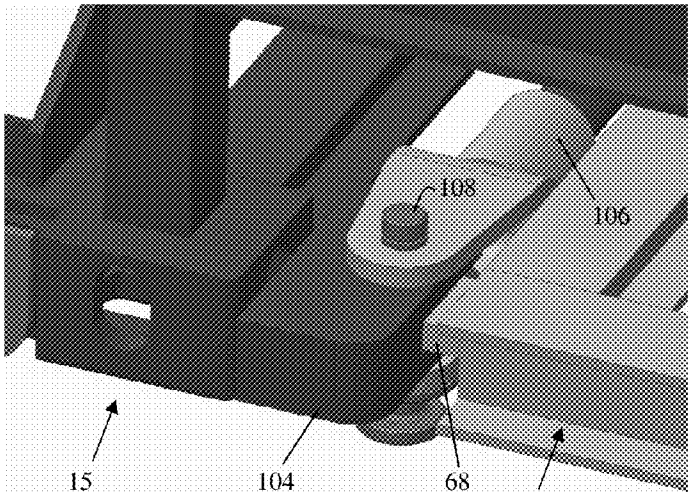
Figure 12:
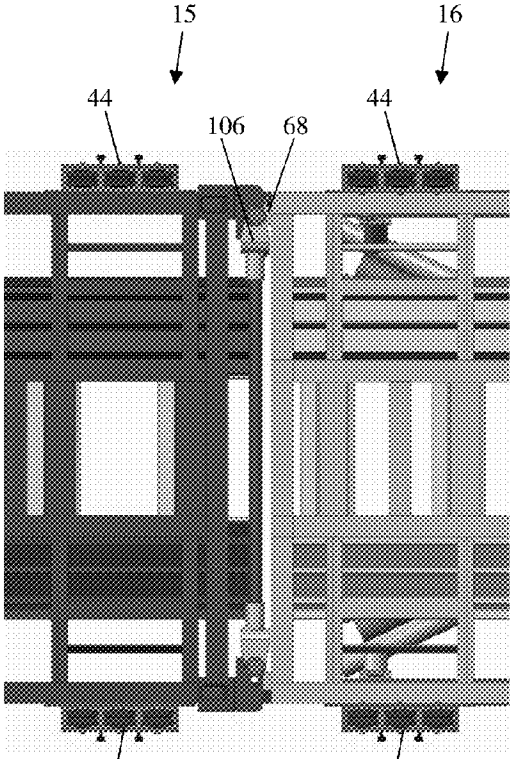

FIGS. 10-12 show aspects of an exemplary implementation of a lock assembly in accordance with aspects of the invention. Specifically, FIG. 10 shows the forward end of the aft cradle 15 engaged with the aft end of the transfer cradle 16. FIG. 11 shows a magnified view of the portion of FIG. 10 indicated by area 102. As illustrated in FIG. 11, the transfer cradle lock element 68 at the aft end of the transfer cradle 16 is insertable into a forward portion 104 of the aft cradle 15. In this position shown in FIG. 11, a linkage 106 that is movably connected to the aft cradle 15 is movable into a position where a pin 108 connected to the linkage 106 engages the transfer cradle lock element 68. The engagement between the pin 108 and the transfer cradle lock element 68 locks the transfer cradle 16 to the aft cradle 15. FIG. 12 shows an underside view of the transfer cradle 16 and the aft cradle 15, including the linkage 106 and the transfer cradle lock element 68. FIG. 12 also illustrates the trucks 44 on each of the cradles 15, 16 for reference.

Figure 13:
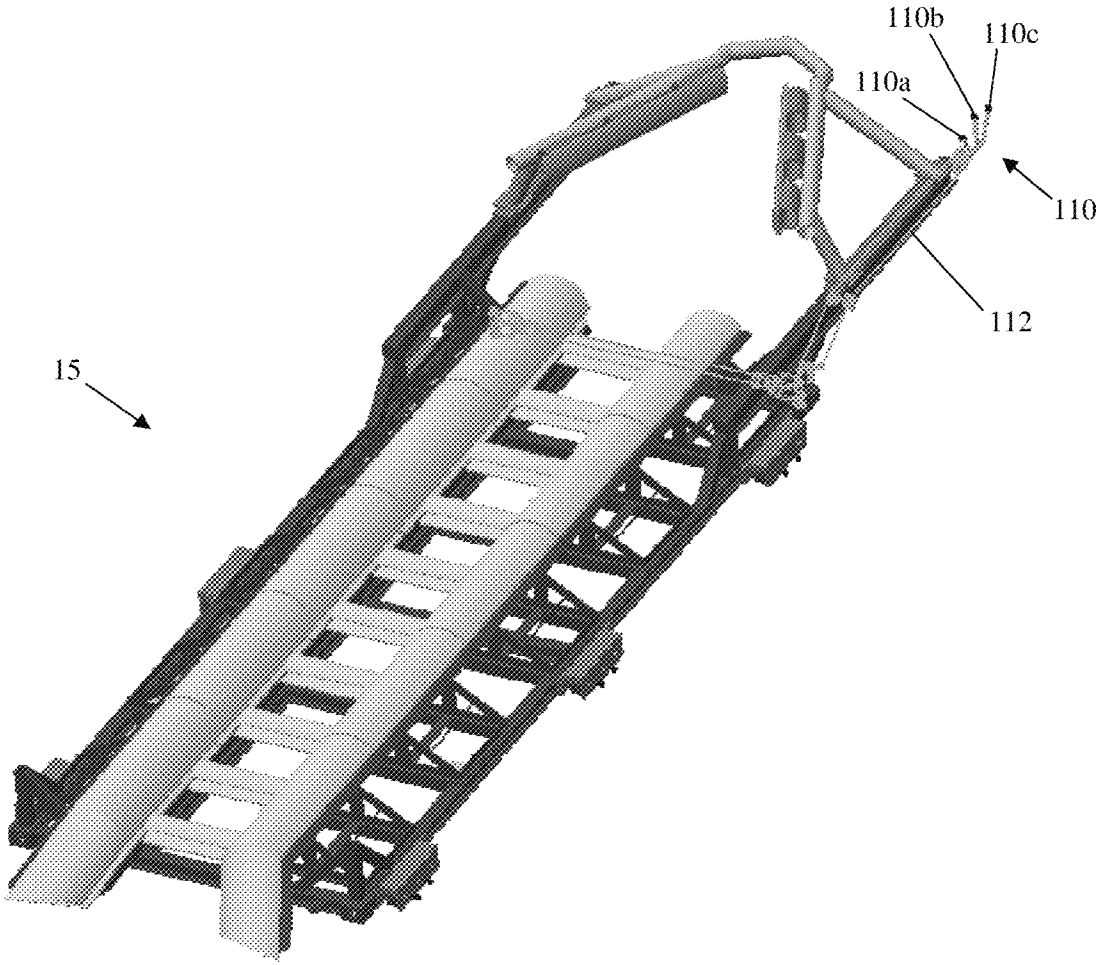
Figure 14:
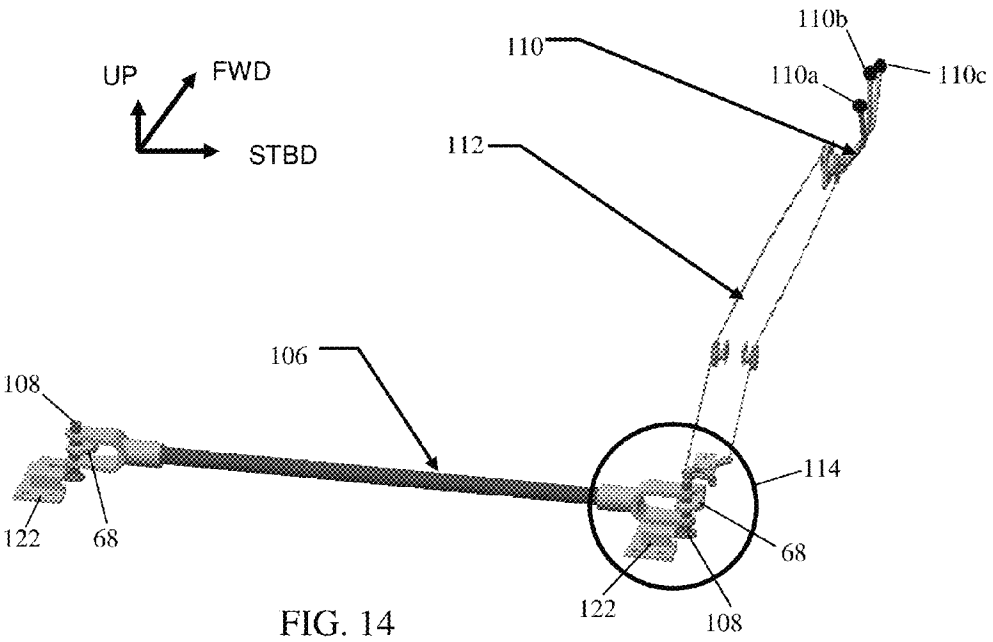
Figure 15:
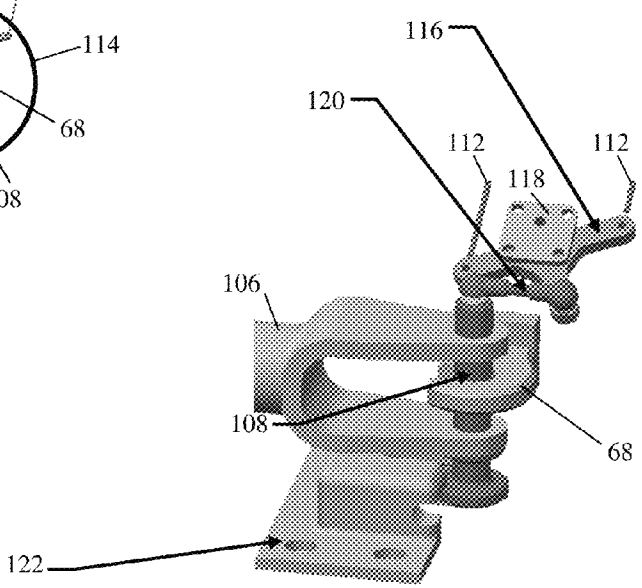

FIGS. 13-15 show further aspects of the exemplary implementation of the lock assembly. Specifically, FIG. 13 shows an actuation system including a lever 110 and cables 112 arranged on the frame of the aft cradle 15. In embodiments, the lever 110 is movable to three distinct positions, 110*a*, 110*b*, 110*c* each of which corresponds to a respective one of the three modes of operation of the lock assembly. FIG. 14 shows the lever 110 and cables 112, with the aft cradle 15 omitted from view for clarity. FIG. 15 shows a magnified view of area 114 of FIG. 14. As shown in FIGS. 14 and 15, in embodiments the cables 112 are connected to first and second ends of a "T" shaped arm 116 that is pivotally connected to a mounting plate 118 that is affixed to the aft cradle 15. A first end of a link 120 is connected to a third end of the "T" shaped arm 116, and a second end of the link 120 is connected to the lock pin 108. The lock pin 108 is fixedly connected to the linkage 106. The linkage 106 is connected to the aft cradle 15 such that the linkage 106 (and the lock pin 108) may translate in a transverse (athwartship) direction relative to the aft cradle 15 in response to movement of the lever 110.

Figure 16:
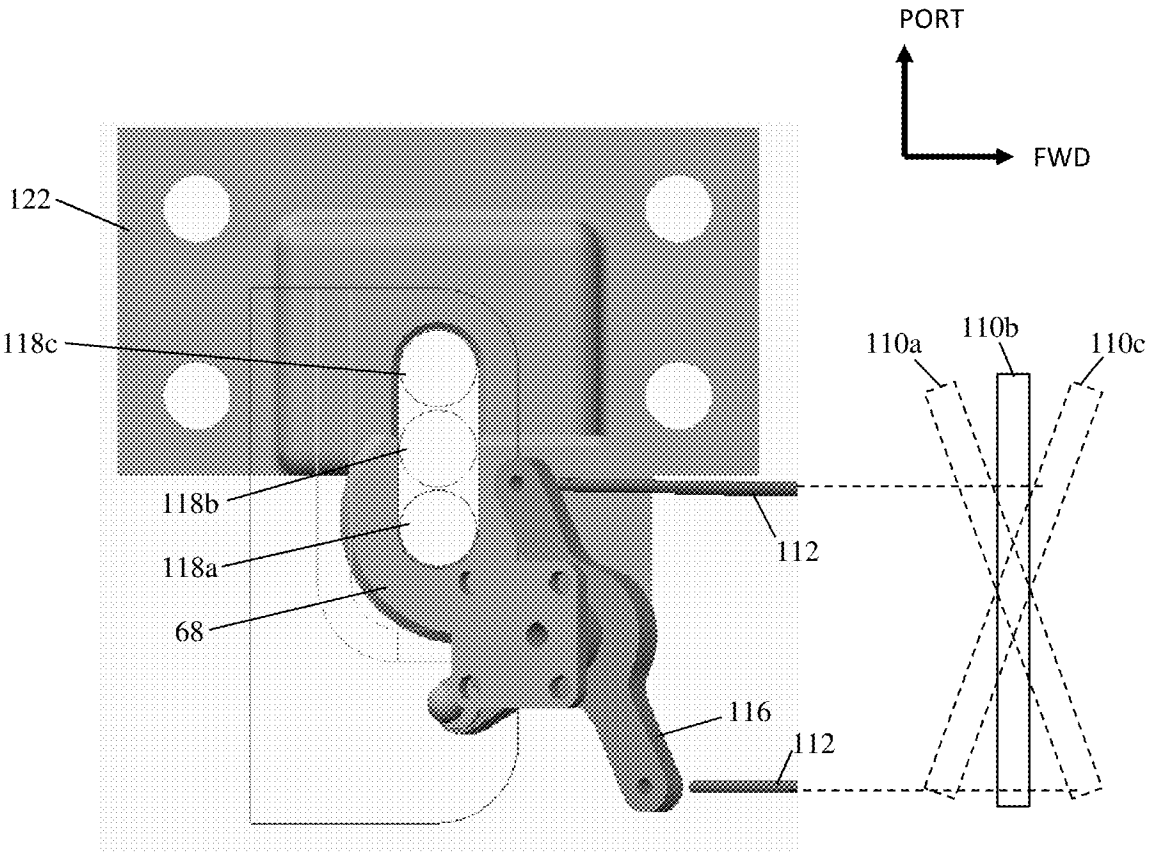

Also depicted in FIGS. 14 and 15 is the transfer cradle lock element 68 that is connected to the transfer cradle 16, and a ramp receiver block 122 that is affixed (e.g., bolted) to a surface of the ship. In embodiments, a first portion of the lock pin 108 may be brought into contact with the transfer cradle lock element 68 to prevent forward and aft movement of the locked cradles relative to one another. In embodiments, a second portion of the lock pin 108 may be brought into contact with the ramp receiver block 122 to prevent forward and aft movement of the aft cradle 15 to the ramp receiver block 122, which thus prevents forward and aft movement of the aft cradle 15 to the ship. In embodiments, a third portion of the lock pin 108 (i.e., a flange) may be brought into contact with a second portion of the ramp receiver block 122 to prevent vertical movement of the aft cradle 15 to the ramp receiver block 122, which thus prevents vertical movement of the aft cradle 15 to the ship FIG. 16 shows positions of the lock pin 108 relative to both the transfer cradle lock element 68 and the ramp receiver block 122 in accordance with aspects of the invention. When the lever 110 is moved to the first position 110*a*, the cables 112, arm 116, and link 120 cooperate to move the lock pin 108 to a first position 118*a*. In embodiments, the lock pin 108 being in the first position 118*a* corresponds to a first mode of the lock assembly in which the aft cradle 15 is locked only to the transfer cradle 16 (via the lock pin 108 engaging the transfer cradle lock element 68). In the first mode of operation, the after vehicle cradle 15 is not locked to the deck of the ship due to the lock pin 108 not being engaged with the ramp receiver block 122. In this mode, the aft cradle 15 and the transfer cradle 16 can move (roll) along the track sections locked together as single unit.

When the lever 110 is moved to the second position 110*b*, the cables 112, arm 116, and link 120 cooperate to move the lock pin 108 to a second position 118*b*. In embodiments, the lock pin 108 being in the second position 118*b* corresponds to a second mode of the lock assembly in which the aft cradle 15 is locked to both the transfer cradle 16 (via the lock pin 108 engaging the transfer cradle lock element 68) and the ship (via the lock pin 108 engaging the ramp receiver block 122). In this mode, both the aft cradle 15 and the transfer cradle 16 are prevented from moving (rolling) along the track sections due to both being locked to the ramp receiver block 122.

When the lever 110 is moved to the third position 110*c*, the cables 112, arm 116, and link 120 cooperate to move the lock pin 108 to a third position 118*c*. In embodiments, the lock pin 108 being in the third position 118*c* corresponds to a third mode of the lock assembly in which the aft cradle 15 is locked only to the ship (via the lock pin 108 engaging the ramp receiver block 122). In the third mode of operation, the aft cradle 15 is not locked to the transfer cradle 16 due to the lock pin 108 not being engaged with the transfer cradle lock element 68. In this mode, the aft cradle 15 is prevented from moving (rolling) along the track sections, while the transfer cradle 16 is permitted to move (roll) along the track sections.

The lock assembly according to aspects of the invention is not limited to the particular example shown in FIGS. 10-16. For example, the lock assembly may include only a single transfer cradle lock element 68, lock pin 108, and ramp receiver block 122. Alternatively, the lock assembly may include plural sets of transfer cradle lock element 68, lock pin 108, and ramp receiver block 122, such as one set at each of the port and starboard sides of the cradles. Moreover, although the lock assembly is shown and described with respect to the aft cradle 15 and the transfer cradle 16, a similar locking system may be employed at the interface between the forward end of the transfer cradle 16 and the aft end of the forward cradle 17. In other embodiments, the transfer cradle may be eliminated, and the lock assembly may be employed at the interface between the forward end of the aft cradle 15 and the aft end of the forward cradle 17. Moreover, plural ramp receiver blocks 122 may be connected to the deck at different forward/aft locations, such that a particular one of the cradles (e.g., aft cradle 15) can be locked to the deck at different forward/aft locations using different ramp receiver blocks 122.

Moreover, the lock assembly is not limited to the manual actuation system shown (including the lever 110 and cables 112). Rather, any suitable actuation system may be used to move the lock pin to the three different positions corresponding to the described three modes of operation. As but one example of an alternative embodiment, the lock system may be implemented with a fully or partially automated actuation system that utilizes electromechanical and/or pneumatic actuators to move the lock pin 108 to the desired positions.

FIGS. 17A-30B show exemplary steps for launching waterborne vessels using the system in accordance with aspects of the invention. In all of FIGS. 17A-30B, figures denoted by "A" are a top view and figures denoted by "B" are a side view, with figures denoted by the same number (e.g., FIGS. 17A and 17B) being corresponding top and side views of the same step.

In describing the steps depicted in FIGS. 17A-30B, reference is made to locking/unlocking cradles to one another and locking/unlocking cradles to the deck or stern door of the ship. All such locking/unlocking may be performed using a lock assembly similar to that described in FIGS. 10-16. For example, each of the cradles 15, 16, 17 may include a respective lever 110, cables 112, arm 116, link 120, and lock pin 108. Moreover, each of the cradles may include one or more structural elements that are configured to lock with a lock pin 108 of an adjacent cradle. Further, plural instances of the ramp receiver block 122 may be connected to the deck and stern door at different locations in the forward/aft direction of the ship longitudinal centerline.

Figure 17A:
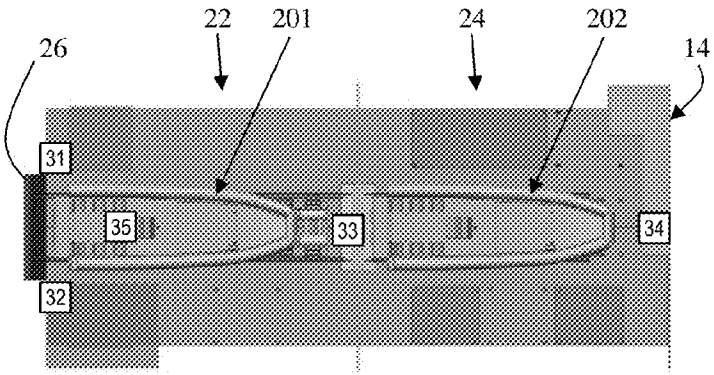
Figure 17B:
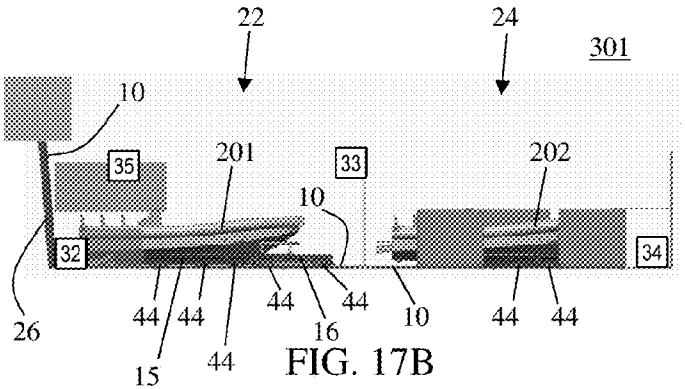

Specifically, FIG. 17A shows a top view and FIG. 17B shows a corresponding side view (looking port) of the system arranged in the first area 22 and the second area 24 of the ship 14 (e.g., as shown in FIG. 1). As shown in FIGS. 17A-B, a first RHIB 201 is supported on the aft cradle 15 in the first area 22 (e.g., the WMZ area), and a second RHIB 202 is supported on the forward cradle 17 in the second area 24 (e.g., the storage area). The transfer cradle 16 is between the aft cradle 15 and the forward cradle 17. All three cradles 15, 16, 17 include trucks 44 arranged on a track system including parallel track sections 10 that straddle a centerline of the ship 14, such that all three cradles 15, 16, 17 may be selectively moved (rolled) along the track system (e.g., as described with respect to FIG. 4). In embodiments, the forward cradle 17 is locked to the deck of the ship 14 in the second area 24 during LHRS operations; however, the invention is not limited to this implementation, and the forward cradle 17 may be unlocked from the deck and moved when desired.

As shown in FIGS. 17A-B, and as described earlier with respect to FIG. 1, aspects of the invention utilize winches 31, 32, 33, 34 to control movement of the cradles 15, 16 along the track sections 10. In embodiments, the winches 31, 32, 33, 34 are arranged in a payout/tension configuration to simultaneously control both forward and aft movement of one or more of the cradles 15, 16 along the track sections 10. Optionally, winches 31, 32 may be omitted and replaced by a single overhead winch 35. Conventional winches may be used. As but one example, electric powered winches that are controlled by personnel on the ship may be used in implementations of the invention. As described herein, cables connected to the winches are connected to and disconnected from various ones of the cradles and RHIBs during launch and recovery operations, and these connections and disconnections may be performed by personnel on the ship using conventional cable connecting mechanisms.

The invention is not limited to winches, and other modes may be employed for causing and controlling movement of the cradles and payload. As but one example, a rack gear may be incorporated into the track sections 10 and electric-powered pinion gears may be incorporated into the trucks 44, such that movement of the cradles along the track sections is caused by and controlled by the motorized rack and pinion gear system.

FIGS. 17A and 17B show a first step (301) in accordance with aspects of the invention. At step 301, the aft cradle 15 is locked to the deck of the ship 14 in the first area 22, and the forward cradle 17 is locked to the deck in the second area 24. Step 301 may also include assembling the cradles 15, 16, 17 on the track sections. For example, the aft cradle 15 and transfer cradle 16 may be in a stowed positon in the first area 22. Step 301 may thus include moving the aft cradle 15 and/or the transfer cradle 16 from a stowed position to a position over the track sections, and attaching the trucks to the cradles. The stern door 26 is in a closed position (i.e., in a raised position and closes an opening at the stern of the ship 14).

Figure 18A:
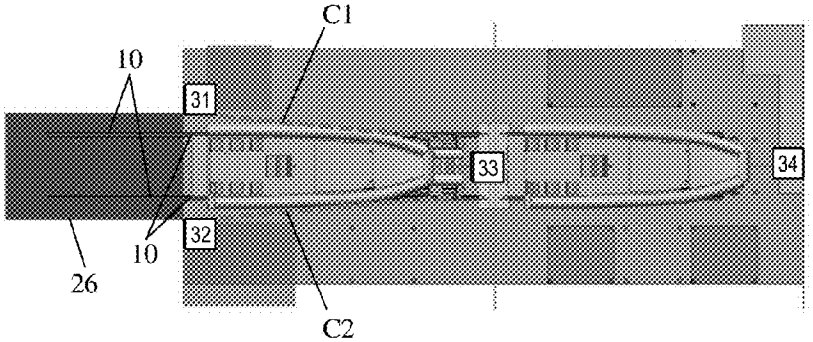
FIGS. 17A-30B show steps of a method of launching and recovering vessels using a system of the present invention.
Figure 18B:
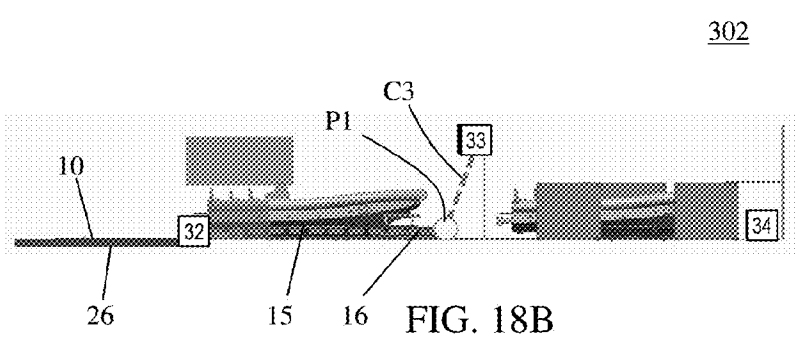

FIGS. 18A and 18B show a second step (302) in accordance with aspects of the invention. At step 302, cables C1, C2 from winches 31, 32 are connected to the transfer cradle 16 in order to provide a force that urges the transfer cradle 16 in the aft direction. Also at step 302, a cable C3 from winch 33 is routed through a pulley P1 and connected to the transfer cradle 16 in order to provide a force that urges the transfer cradle 16 in the forward direction. In this manner, the plural winches 31, 32, 33 are connected to the transfer cradle in a payout/tension system, such that both the forward and aft movement of the transfer cradle 16 may be controlled when the transfer cradle 16 is unlocked from the deck.

Still referring to FIGS. 18A-B, after attaching the winch cables, the transfer cradle 16 is unlocked from the deck, and the winches 31, 32, 33 are actuated to move the transfer cradle 16 in the aft direction to the point that the transfer cradle 16 engages with the aft cradle 15. The transfer cradle 16 is then locked to the aft cradle 15. Step 302 also includes moving (e.g., pivoting) the stern door 26 from a closed positon (shown in FIGS. 17A-B) to a first open position (shown in FIGS. 18A-B). In embodiments, the stern door 26 is substantially horizontal in the first open position (e.g., horizontal plus or minus a few degrees), and is locked into place in this position using a mechanism that is suitable for controlling the pivoting movement of the door. The stern door 26 may be moved as described herein using any suitable mechanism, such as a hydraulic system, without limitation. As described herein, the stern door 26 has track sections 10 that align with track sections 10 in the first area 22 when the stern door 26 is in the first open position, such that the aft cradle 15 may roll from the track sections 10 in the first area to the track sections 10 on the stern door 26.

Figure 19A:
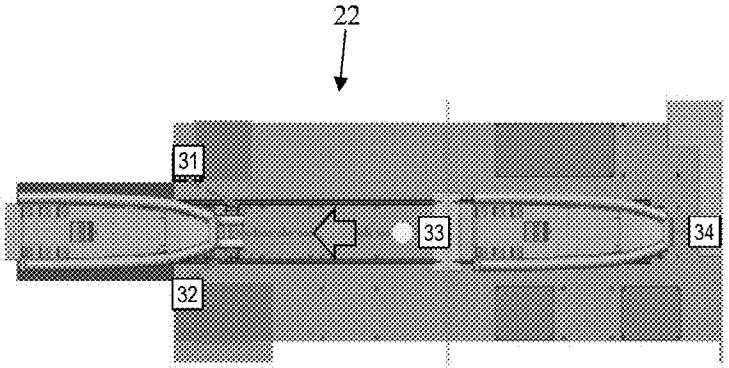
Figure 19B:
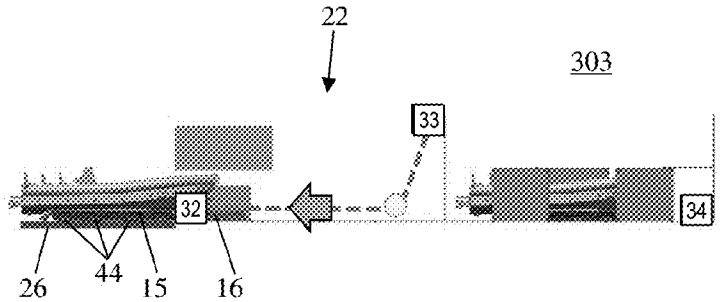

FIGS. 19A and 19B show a third step (303) in accordance with aspects of the invention. At step 303, the aft cradle 15 is unlocked from the deck in the first area 22 while remaining locked to the transfer cradle 16. In this manner, the aft cradle 15 and the transfer cradle 16 are locked together and are capable of moving along the track sections 10. Step 303 also includes actuating the winches 31, 32, 33 to move the aft cradle 15 and the transfer cradle 16 together in the aft direction, such that all the trucks 44 of the aft cradle 15 are on track sections 10 on the stern door 26. Step 303 also includes locking the aft cradle 15 to the stern door, e.g., using the lock assembly described herein with a ramp receiver block that is fixedly connected (e.g., bolted) to the stern door 26. In embodiments, the system may be configured such that a cradle can be locked to another ship structure, or to both the ship and the stern door, e.g., in a fixed ramp configuration.

Figure 20A:
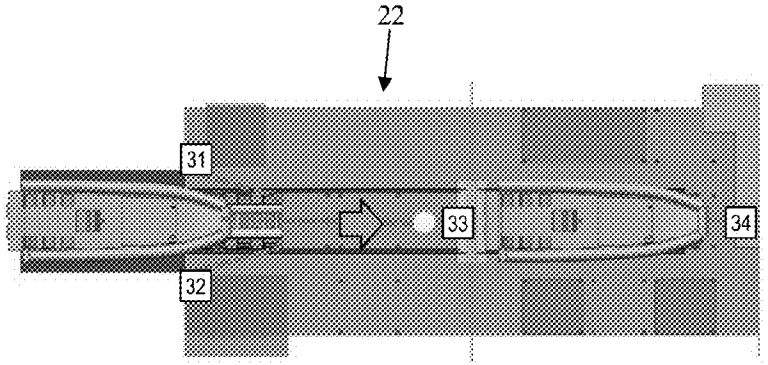
Figure 20B:
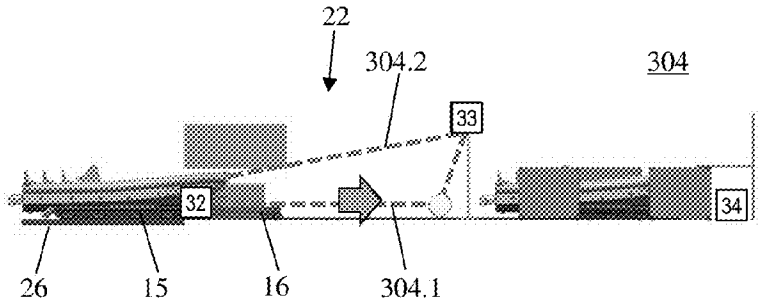

FIGS. 20A and 20B show a fourth step (304) in accordance with aspects of the invention. At step 304, the transfer cradle 16 is disconnected from the aft cradle 15. The winches 31, 32, 33 are actuated to move the transfer cradle 16 forward while the aft cradle 15 remains locked to the stern door 26. The transfer cradle 16 is then locked to the deck in the first area 22. The cable attached to winch 33 is disconnected from the transfer cradle 16 and the pulley P1 (shown at 304.1), and then connected directly to the RHIB 201 that is supported by the aft cradle 15 on the stern door 26 (shown at 304.2).

Figure 21A:
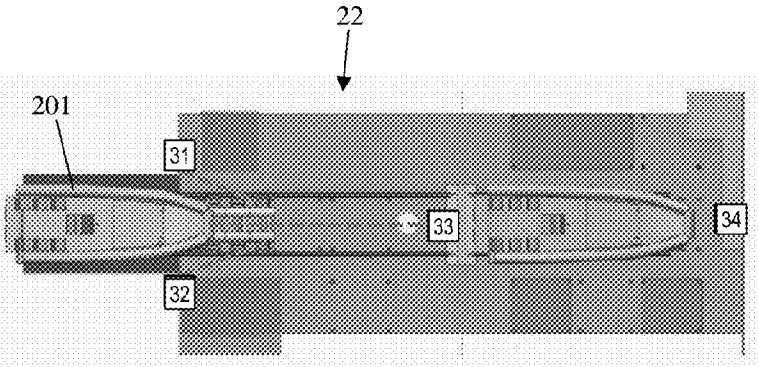
Figure 21B:
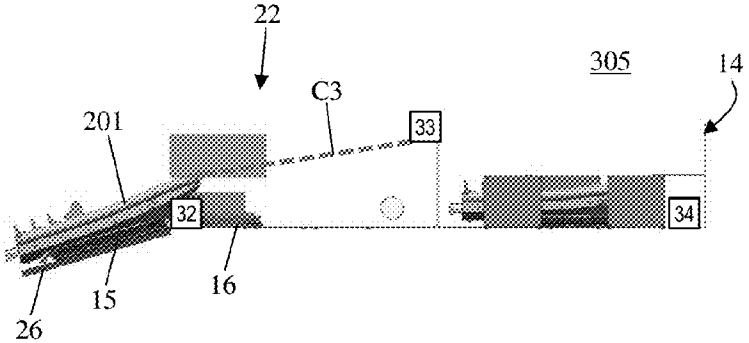

FIGS. 21A and 21B show a fifth step (305) in accordance with aspects of the invention. At step 305, the stern door 26 is unlocked and moved from the first open position to a second open position. In embodiments, the second open position is a launch position that is angled downward relative to the first open position. For example, at the first open positon the stern door 26 may be substantially horizontal, and at the second open position the stern door 26 may be angled at about 15° downward relative to horizontal. The invention is not limited to 15° though, and any suitable angle for launching the RHIB s may be used for the second open position. The stern door 26 is then locked in the second open position. The aft cradle 15 is locked to the stern door 26 with the RHIB 201 being supported by the aft cradle 15 and held by the cable C3 from the winch 33, such that the aft cradle 15 pivots with the stern door 26 relative to the ship 14 while the transfer cradle 16 remains in the first area 22.

Figure 22A:
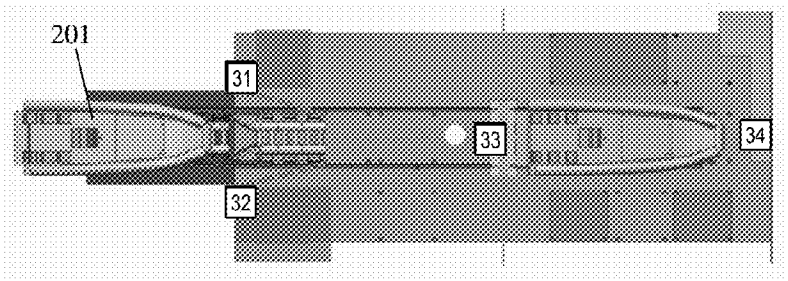
Figure 22B:
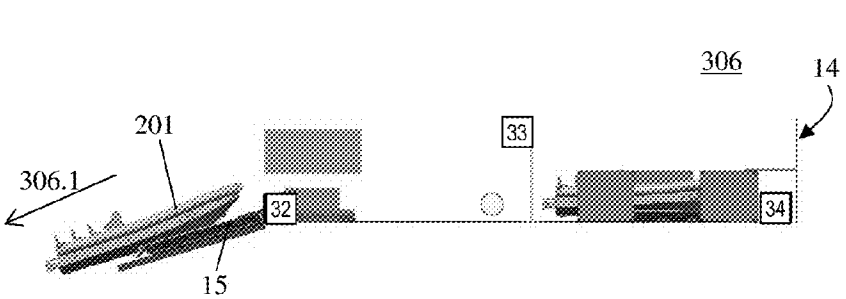

FIGS. 22A and 22B show a sixth step (306) in accordance with aspects of the invention. At step 306, the cable from the winch 33 is disconnected from the RHIB 201, and the RHIB 201 is floated off the aft cradle 15 and onto the water surrounding the ship 14, as indicated by arrow 306.1. At this point, the first RHIB 201 has been launched from the ship 14.

Figure 23A:
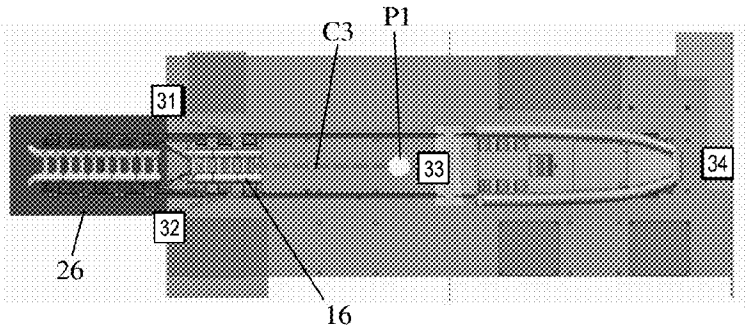
Figure 23B:
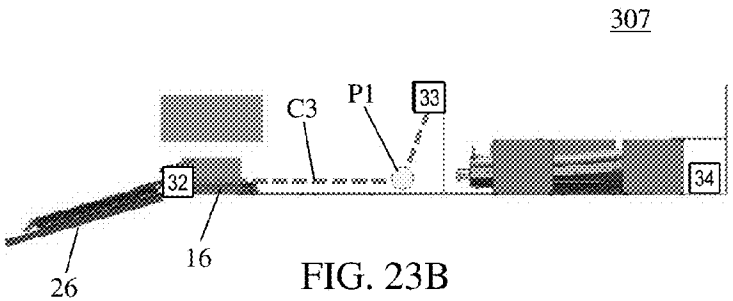

FIGS. 23A and 23B show a seventh step (307) in accordance with aspects of the invention. At step 307, the cable C3 from the winch 33 is routed through the pulley P1 and connected to the transfer cradle 16, e.g., in a manner similar to that described with respect to step 302. This provides tension on the winch cable and the transfer cradle 16. Step 307 also includes unlocking the stern door 26 from the second open position.

Figure 24A:
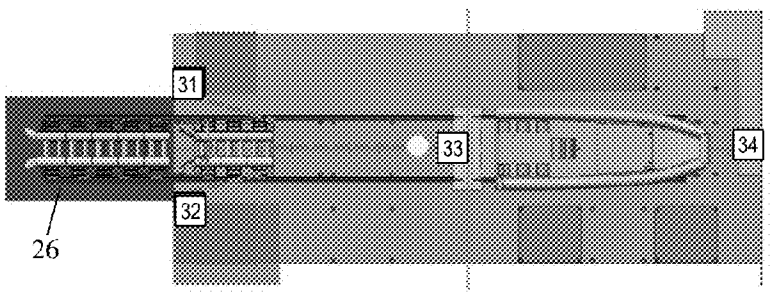
Figure 24B:
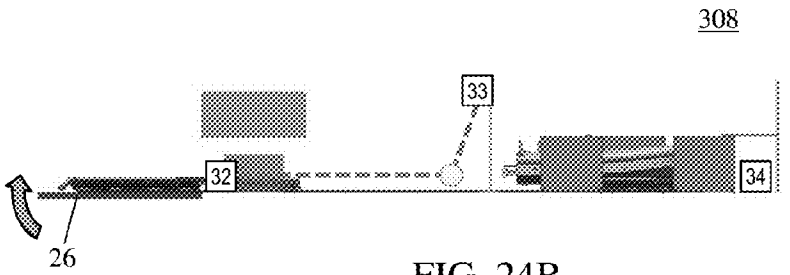

FIGS. 24A and 24B show an eighth step (308) in accordance with aspects of the invention. At step 308, the stern door 26 is moved (pivoted) from the second open positon to the first open position, and then locked in the first open position.

Figure 25A:
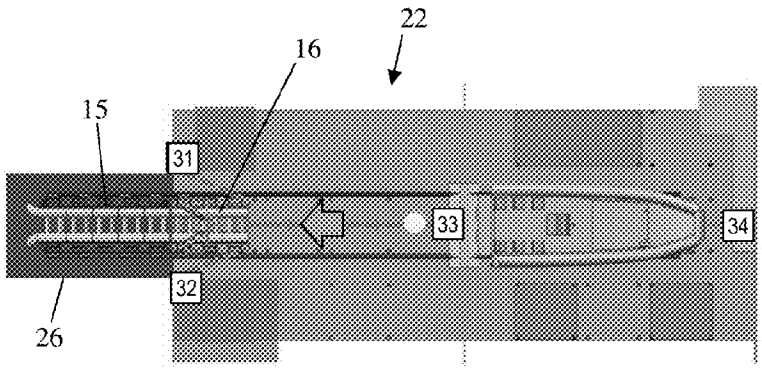
Figure 25B:
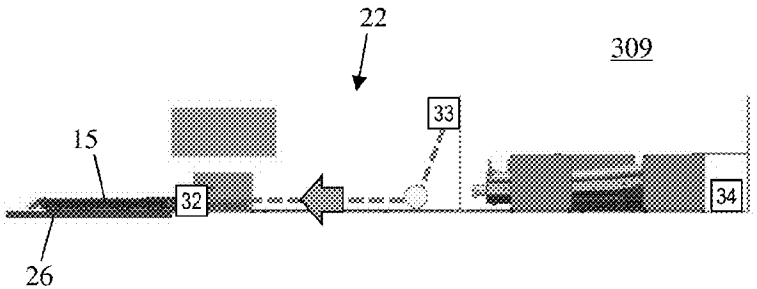

FIGS. 25A and 25B show a ninth step (309) in accordance with aspects of the invention. At step 309, the transfer cradle 16 is unlocked from the deck in the first area 22. The winches 31, 32, 33 are actuated to move the transfer cradle 16 in the aft direction until the transfer cradle 16 engages the aft cradle 15. The aft cradle 15 is locked to the transfer cradle 16 and unlocked from the stern door 26.

Figure 26A:
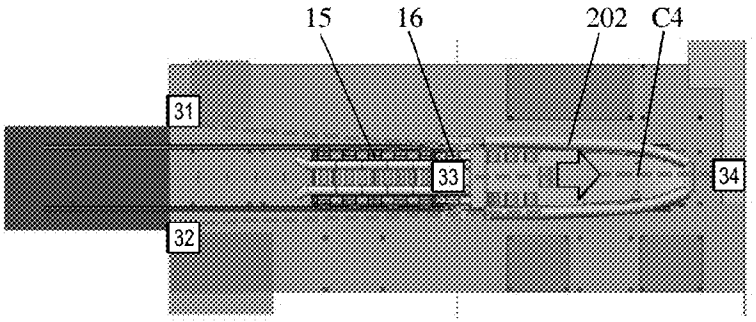
Figure 26B:
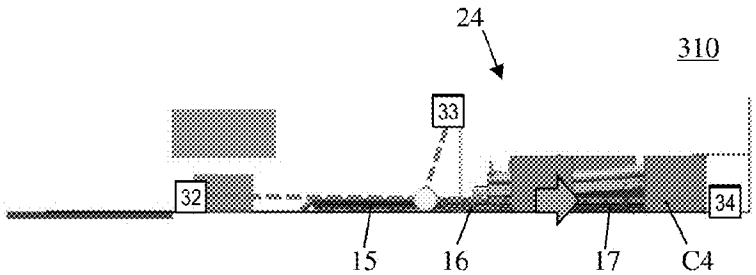

FIGS. 26A and 26B show a tenth step (310) in accordance with aspects of the invention. At step 310, the winches 31, 32, 33 are actuated to move the transfer cradle 16 and the aft cradle 15, together, forward into the first area 22. The cable C4 connected to the winch 34 is connected to the transfer cradle 16, after which the cable connected to the winch 33 is disconnected from the transfer cradle 16. The winches 31, 32, 34 are actuated to move the transfer cradle 16 and the aft cradle 15, together, forward until the transfer cradle 16 engages the forward cradle 17 in the second area 24. The transfer cradle 16 is then locked to the forward cradle 17, which is supporting the second RHIB 202.

Figure 27A:
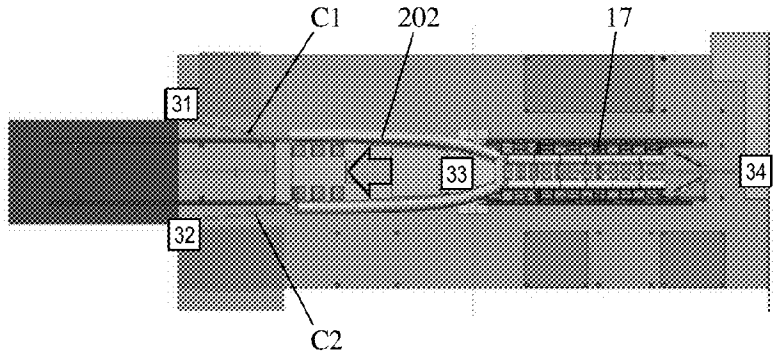
Figure 27B:
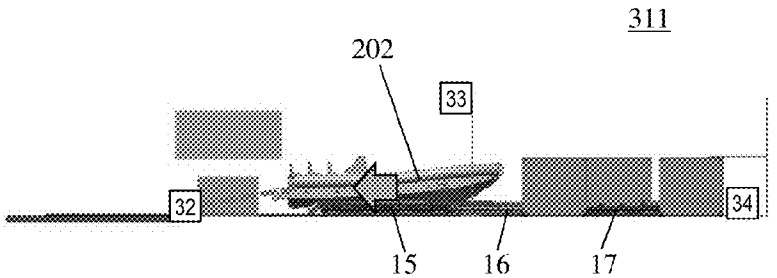

FIGS. 27A and 27B show an eleventh step (311) in accordance with aspects of the invention. At step 311, the cables C1, C2 connected to the winches 31, 32 are disconnected from the transfer cradle 16, and are subsequently connected to the aft end of the RHIB 202. The cable C4 connected to winch 34 is disconnected from the transfer cradle 16 and subsequently to the forward end of the RHIB 202 as well to provide a tension/payout setup similar to previous steps. The winches 31, 32, and 34 are then actuated to move (pull) the RHIB 202 in the aft direction such that the RHIB 202 moves off the forward cradle 17, over and across the transfer cradle 16, and onto the aft cradle 15. In embodiments where the aft cradle 15 includes a bow stop as described in FIG. 2, the bow stop may optionally be removed or pivoted out of the way prior to sliding the RHIB 202 over the front end of the aft cradle 15.

Figure 28A:
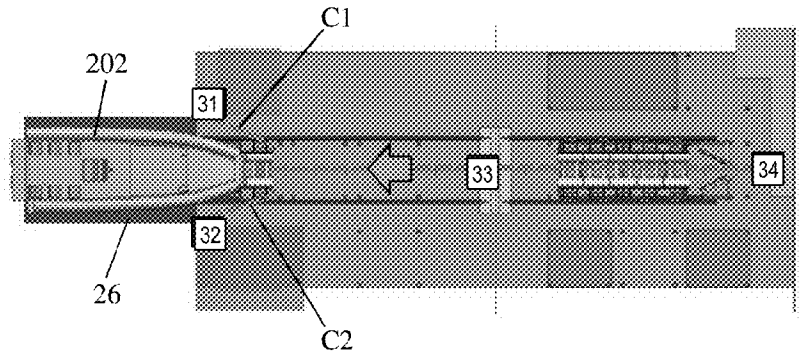
Figure 28B:
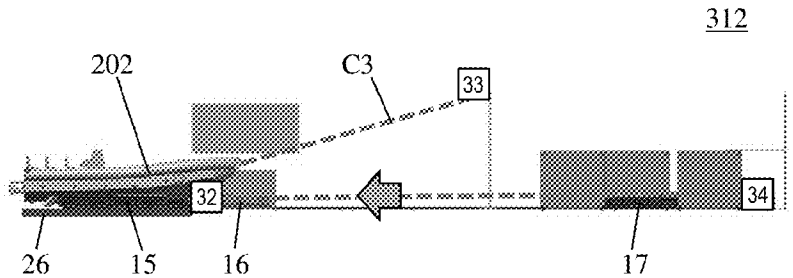

FIGS. 28A and 28B show a twelfth step (312) in accordance with aspects of the invention. At step 312, the cables C1, C2 connected to the winches 31, 32 are disconnected from the RHIB 202 and subsequently connected to the transfer cradle 16. The cable C4 connected to winch 34 is disconnected from the RHIB 202 and subsequently connected to the transfer cradle 16. The winches 31, 32, 34 are then actuated to move the aft cradle 15 and the transfer cradle 16, together, in the aft direction until all the trucks of the aft cradle 15 are on track sections on the stern door 26. The aft cradle 15 is then locked to the stern door 26. The cable connected to the winch 33 is then connected to the front end of the RHIB 202. The forward cradle 17 remains locked to the deck in the second area.

Figure 29A:
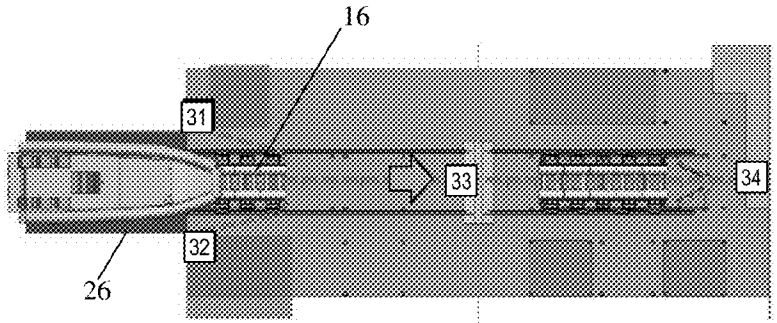
Figure 29B:
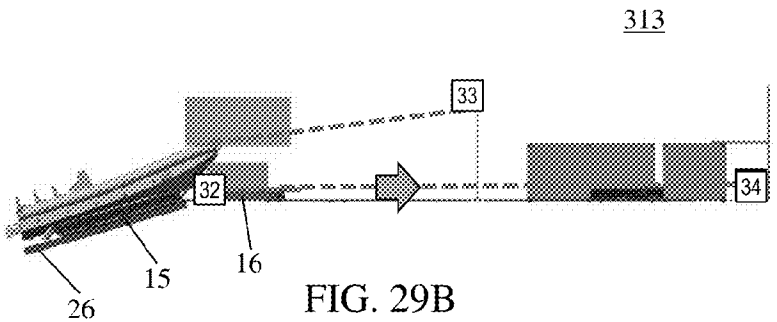

FIGS. 29A and 29B show a thirteenth step (313) in accordance with aspects of the invention. At step 313, the transfer cradle 16 is unlocked from the aft cradle 15 while the aft cradle 15 remains locked to the stern door 26. The winches 31, 32, 34 are actuated to move the transfer cradle 16 in the forward direction, away from the aft cradle 15 and into the first area 22. The transfer cradle 16 is then locked to the deck in the first area 22. The stern door 26 is moved (pivoted) to the second open position and locked into place at the second open position, with the aft cradle 15 locked to the stern door 26.

Figure 30A:
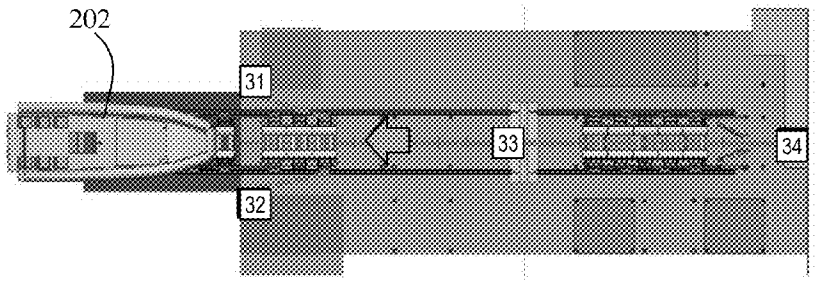
Figure 30B:
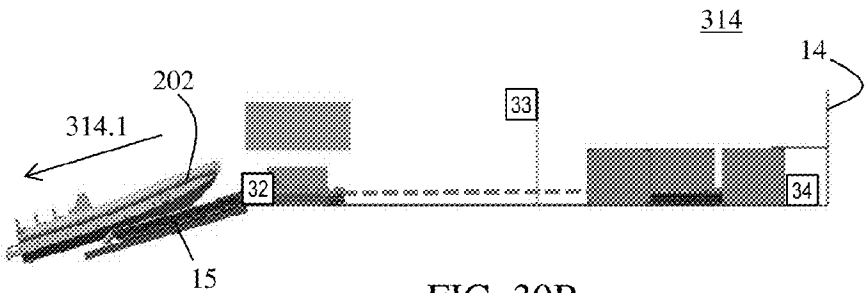

FIGS. 30A and 30B show a fourteenth step (314) in accordance with aspects of the invention. At step 314, the cable connected to the winch 33 is disconnected from the RHIB 202, and the RHIB 202 is floated off the aft cradle 15 into the water surrounding the ship 14, as indicated by arrow 314.1. At this point, the second RHIB 202 has been launched from the ship 14.

FIGS. 17A-30B thus illustrate an exemplary launch operation for launching two RHIBs using a single track system and without having to remove any of the cradles 15, 16, 17 from the track system. Recovery operations for the RHIBs may be performed by reversing the described steps.

Figure 31:
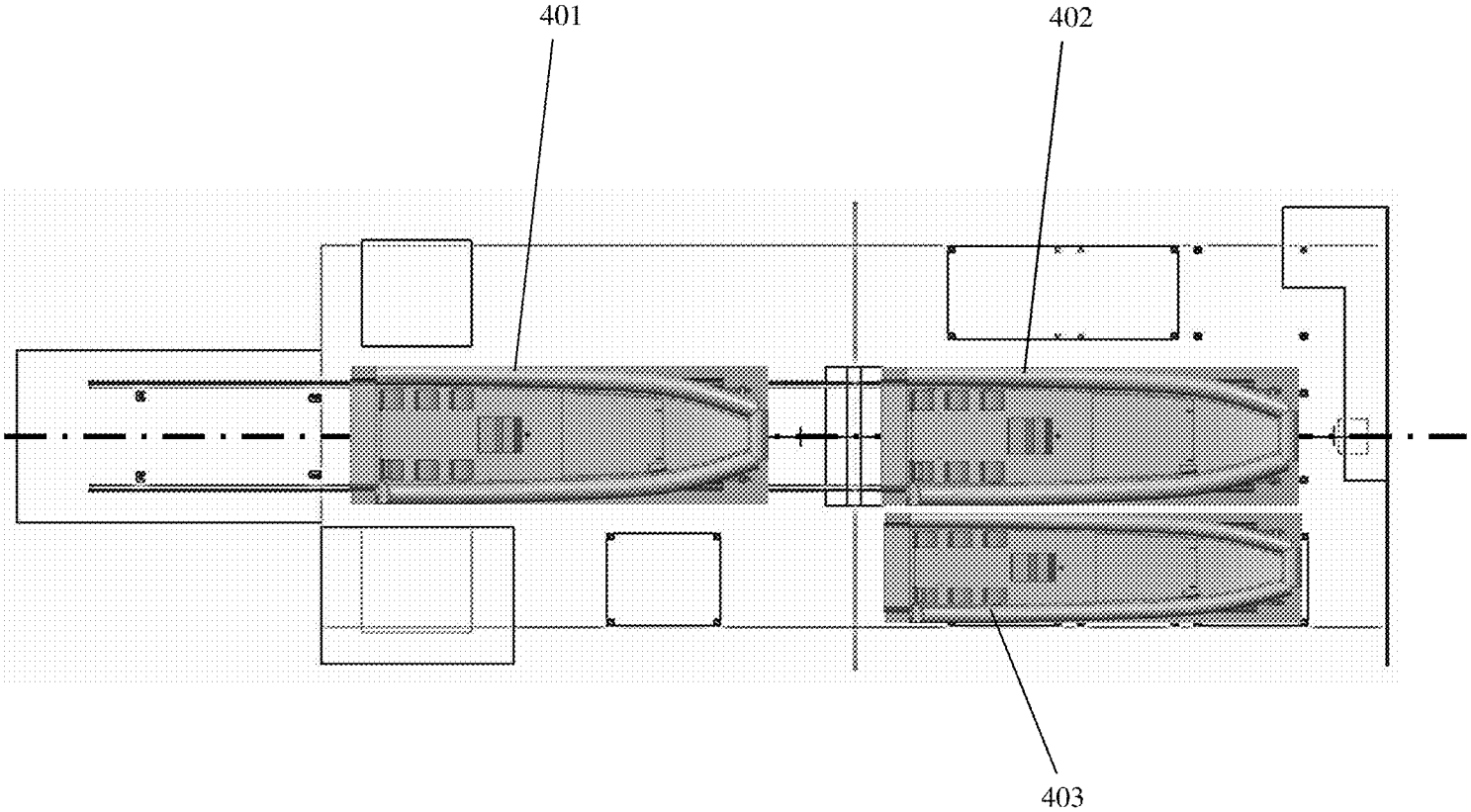
FIG. 31 shows an alternate implementation of a system according to aspects of the present invention.

Aspects of the invention may be implemented using modular track components and truck assemblies that are described in U.S. application Ser. No. 14/317,857, filed Jun. 27, 2014, the contents of which are incorporated by reference herein in their entirety. For example, as shown in FIG. 31, first and second RHIBs 401, 402 may be stored at locations on the longitudinal centerline of the ship, and a third RHIB 403 may be stored at a location offset from the longitudinal centerline in an athwart ship direction. First track sections may be arranged at an angle (e.g., 90°) relative to second track sections that run along the longitudinal (fore and aft) direction of the ship. The first and second track sections may be similar to the modular track components described in U.S. application Ser. No. 14/317,857. Further, cradles holding a RHIB may be fitted with trucks similar to the trucks described in U.S. application Ser. No. 14/317,857, which are moveable along the first and second track sections. The system can thus move a cradle and RHIB along the first track sections in an athwart ship direction from a first (storage) location to a second (intermediate) location, and subsequently move the cradle and RHIB along the second track sections in a longitudinal ship direction from the second location to a third (launch) location.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

It is further noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular materials and embodiments, the present invention is not intended to be limited to the particulars disclosed herein; rather, the present invention extends to all functionally equivalent structures, methods and uses, and combinations thereof such as are within the scope of the appended claims.

What is claimed is:

1. A launch, recovery, and handling system, comprising:

a track system arranged on a deck of a ship and a stern door of the ship; and an aft cradle and a forward cradle that are connected to the track system and moveable in first and second directions along the track system, wherein the aft cradle is moveable from a first position at a first area inside the ship to a second position on the stern door for at least one of launching and recovering a payload.

2. The system of claim 1, wherein the stern door is pivotable relative to a hull of the ship between a closed position, a first open position, and a second open position.

3. The system of claim 2, wherein:

in the first position the stern door is angled upward relative to horizontal and closes an opening at the stern of the ship;

in the second position the stern door is substantially horizontal; and in the third position the stern door is angled downward relative to horizontal.

4. The system of claim 1, wherein the payload comprises plural waterborne vessels.

5. The system of claim 4, wherein the system is structured and arranged to launch the waterborne vessels from the ship without using a crane.

6. The system of claim 1, wherein:

the track system comprises track sections that are substantially parallel to a longitudinal centerline of the ship;

the first direction is forward; and the second direction is aft.

7. The system of claim 6, wherein the track sections traverse a watertight threshold between the first area of the ship and a second area of the ship.

8. The system of claim 1, wherein the aft cradle comprises trucks that roll on the track system.

9. The system of claim 8, wherein the trucks and the track system are structured and arranged such that the trucks are prevented from moving in an athwartship direction when the trucks are on the track system.

10. The system of claim 9, wherein the trucks and the track system are structured and arranged such that the trucks are prevented from moving beyond a predefined limit in a vertical direction when the trucks are on the track system.

11. The system of claim 1, further comprising winches that control movement of the aft cradle along the track system in the first and second directions.

12. The system of claim 1, further comprising a transfer cradle on the track system between the aft cradle and the forward cradle.

13. The system of claim 12, further comprising a lock assembly that is structured and arranged to provide first, second and third locking modes of the aft cradle.

14. The system of claim 13, wherein the lock assembly is connected to the aft cradle and is configured to be manually operated.

15. The system of claim 13, wherein:

the first locking mode locks the aft cradle to the transfer cradle without locking the aft cradle to the ship;

the second locking mode locks the aft cradle to both the transfer cradle and the ship; and the third locking mode locks the aft cradle to the ship without locking the aft cradle to the transfer cradle.

16. The system of claim 12, wherein the system is structured and arranged to:

support a first waterborne vessel on the aft cradle in the first area of the ship;

support a second waterborne vessel on the forward cradle in a second area of the ship;

move the aft cradle and the first waterborne vessel to the stern door;

deploy the first waterborne vessel from the aft cradle into a body of water surrounding the ship;

move the aft cradle from the stern door to the first area;

move the second waterborne vessel from the forward cradle, over the transfer cradle, and onto the aft cradle;

move the aft cradle and the second waterborne vessel to the stern door; and deploy the second waterborne vessel from the aft cradle into the body of water surrounding the ship.

17. A launch, recovery, and handling system, comprising:

a track system arranged on a deck of a ship and a stern door of the ship;

an aft cradle and a forward cradle that are connected to the track system and moveable in first and second directions along the track system; and a lock assembly that is structured and arranged to provide first, second and third locking modes of the aft cradle;

wherein:

the aft cradle is moveable from a first position at a first area inside the ship to a second position on the stern door for at least one of launching and recovering a payload;

the stern door is pivotable relative to a hull of the ship between a closed position, a first open position, and a second open position;

the aft cradle comprises trucks that roll on the track system.

18. The system of claim 17, wherein:

in the first position the stern door is angled upward relative to horizontal and closes an opening at the stern of the ship;

in the second position the stern door is substantially horizontal;

in the third position the stern door is angled downward relative to horizontal;

the payload comprises plural waterborne vessels; and the system is structured and arranged to launch the waterborne vessels from the ship without using a crane.

19. A method of using a launch, recovery, and handling system, comprising:

supporting a first waterborne vessel on an aft cradle in a first area of a ship;

supporting a second waterborne vessel on a forward cradle in a second area of the ship;

moving the aft cradle and the first waterborne vessel along a track system to a launch and recovery ramp, wherein the track system is arranged at both the first area of the ship and the launch and recovery ramp;

deploying the first waterborne vessel from the aft cradle into a body of water surrounding the ship;

moving the aft cradle, along the track system, from the launch and recovery ramp to the first area;

moving the second waterborne vessel from the forward cradle and onto the aft cradle;

moving the aft cradle and the second waterborne vessel along the track system to the launch and recovery ramp; and deploying the second waterborne vessel from the aft cradle into the body of water surrounding the ship.

20. The method of claim 19, wherein the forward cradle and the aft cradle remain connected to the track system during the moving the second waterborne vessel from the forward cradle and onto the aft cradle.

* * * * *